US009567764B2

(12) United States Patent
Phillips et al.

(10) Patent No.: US 9,567,764 B2
(45) Date of Patent: Feb. 14, 2017

(54) EXPLOSIVE BLAST ENERGY DISSIPATING AND CARRYING BUILDING STRUCTURE

(71) Applicant: TNP Holdings LLC, Estes Park, CO (US)

(72) Inventors: Edward H. Phillips, Glen Haven, CO (US); Tiffany Phillips, Estes Park, CO (US)

(73) Assignee: TNP HOLDINGS LLC, Estes Park, CO (US)

( * ) Notice: Subject to any disclaimer, the term of this patent is extended or adjusted under 35 U.S.C. 154(b) by 0 days.

(21) Appl. No.: 14/847,911

(22) Filed: Sep. 8, 2015

(65) Prior Publication Data

US 2016/0053483 A1 Feb. 25, 2016

Related U.S. Application Data

(63) Continuation-in-part of application No. 14/186,452, filed on Feb. 21, 2014, now Pat. No. 9,127,917, and a continuation-in-part of application No. 13/768,792, filed on Feb. 15, 2013, now Pat. No. 9,383,174.

(60) Provisional application No. 61/767,631, filed on Feb. 21, 2013, provisional application No. 61/599,639,
(Continued)

(51) Int. Cl.

| | |
|---|---|
| ***E04B 2/18*** | (2006.01) |
| ***E04H 9/04*** | (2006.01) |
| ***E04C 2/08*** | (2006.01) |
| ***E04H 9/06*** | (2006.01) |
| ***E04C 2/38*** | (2006.01) |
| ***F41H 5/013*** | (2006.01) |
| ***F41H 5/24*** | (2006.01) |
| ***F41H 5/04*** | (2006.01) |

(Continued)

(52) U.S. Cl.
CPC . *E04H 9/04* (2013.01); *E04B 2/18* (2013.01); *E04C 2/08* (2013.01); *E04C 2/38* (2013.01); *E04H 9/06* (2013.01); *F41H 5/013* (2013.01); *F41H 5/04* (2013.01); *F41H 5/24* (2013.01); *F42D 5/045* (2013.01); *E04H 3/08* (2013.01)

(58) Field of Classification Search
None
See application file for complete search history.

(56) References Cited

U.S. PATENT DOCUMENTS 3,438,168 A * 4/1969 Tischuk ..... E04F 13/0803 52/394
3,583,123 A 6/1971 Holmgren
(Continued)

OTHER PUBLICATIONS

"Missile Resistant Building System Tested at Colorado State University," Colorado State University, Oct. 2001, 2 pages.
(Continued)

*Primary Examiner* — Stephen M Johnson
(74) *Attorney, Agent, or Firm* — Sheridan Ross P.C.

(57) ABSTRACT

A structural assembly for use in building applications is disclosed. The assembly has spaced inner and outer face sheets, as well as one or more intermediate panels positioned between the inner and outer face sheets. The assembly provides an enhanced ability to dissipate blast or projectile impact forces and to carry the forces throughout the assembly, thus maintaining sufficient structural integrity in the building to enable the occupants to evacuate, to enable contents to be evacuated, and to enable reuse of the building itself.

8 Claims, 24 Drawing Sheets

Related U.S. Application Data filed on Feb. 16, 2012, provisional application No. 61/714,941, filed on Oct. 17, 2012.

(51) Int. Cl.
*F42D 5/045* (2006.01)
*E04H 3/08* (2006.01)

(56) References Cited

U.S. PATENT DOCUMENTS 4,267,679 A * 5/1981 Thompson ..... E04C 2/292 52/478
4,299,070 A 11/1981 Oltmanns et al.
4,332,119 A * 6/1982 Toews ..... E04B 2/72 52/481.1
4,433,522 A * 2/1984 Yerushalmi ..... E04H 9/10 52/249
4,677,798 A 7/1987 Phillips
4,731,964 A 3/1988 Phillips
4,850,176 A 7/1989 Munsey et al.
4,928,468 A * 5/1990 Phillips ..... E04B 1/383 109/78
5,228,257 A * 7/1993 Bowersox ..... E04B 2/72 52/588.1
6,298,607 B1 10/2001 Mostaghel et al.
7,651,751 B2 1/2010 Hasch et al.
7,654,768 B1 2/2010 Tullis et al.
7,661,228 B1 2/2010 Nolte et al.
7,802,414 B1 9/2010 Nolte et al.
7,806,037 B2 10/2010 Friedman et al.
7,870,698 B2 1/2011 Tonyan et al.
7,980,165 B2 7/2011 Misencik et al.
8,117,788 B1 2/2012 Mueller et al.
8,127,502 B2 3/2012 Hulls et al.
8,464,479 B2 6/2013 Guirgis
8,677,708 B2 3/2014 Williams
9,127,917 B2 9/2015 Phillips et al.
2007/0094992 A1 5/2007 Antonic
2010/0101171 A1 4/2010 Clifton et al.
2014/0026742 A1 1/2014 Phillips et al.

OTHER PUBLICATIONS

Bienkiewicz et al. "Tornado Missile Impact Resistance of Barrier Construction System," Colorado State University, Final Report for Barrier Construction Systems, Aug. 2001, 36 pages.
Sustainable Building Technologies brochure, 2007, 2 pages.
International Search Report and Written Opinion for International (PCT) Patent Application No. PCT/US2013/026402, mailed Apr. 8, 2013 9 pages.
International Preliminary Report on Patentability for International (PCT) Patent Application No. PCT/US2013/026402, mailed Aug. 28, 2014 8 pages.
Official Action for U.S. Appl. No. 13/768,792, mailed Oct. 30, 2014 7 pages.
Final Action for U.S. Appl. No. 13/768,792, mailed Apr. 3, 2015 7 pages.
Official Action for U.S. Appl. No. 13/768,792, mailed Sep. 30, 2015 5 pages.
Official Action for U.S. Appl. No. 14/186,452, mailed Aug. 26, 2014 5 pages Restriction Requirement.
Official Action for U.S. Appl. No. 14/186,452, mailed Nov. 6, 2014 6 pages.
Notice of Allowance for U.S. Appl. No. 14/186,452, mailed Apr. 20, 2015 7 pages.

* cited by examiner

EXPLOSIVE BLAST ENERGY DISSIPATING AND CARRYING BUILDING STRUCTURE

CROSS REFERENCE TO RELATED APPLICATION

This Non-Provisional Patent Application is a Continuation-in-Part of and claims the benefit of priority from U.S. patent application Ser. No. 14/186,452, filed Sep. 8, 2015 (now U.S. Pat. No. 9,127,917, issued Sep. 8, 2015), which claims the benefit of priority from U.S. Provisional Patent Application No. 61/767,631, filed Feb. 21, 2013, and U.S. patent application Ser. No. 13/768,792, filed Feb. 15, 2013 (now U.S. Pat. No. 9,383,174 issued Jul. 5, 2016), which claims the benefit of priority from U.S. Provisional Patent Application No. 61/599,639, filed Feb. 16, 2012, and U.S. Provisional Patent Application No. 61/714,941, filed Oct. 17, 2012, the entire disclosures of which are hereby incorporated by reference in their entireties.

FIELD OF THE INVENTION

The invention generally relates to an improved building system for use as walls, roofs, floors and also for use in combination with typical building materials for constructing commercial residences and buildings, as well as a retrofit for existing buildings. More particularly, the invention relates to an improved building system that dissipates and carries blasts or projectile impacts throughout the structure and to the foundation of the building of which it is a part.

BACKGROUND

Blast and penetration resistant building structures have been used for many years to protect inhabitants from a variety of natural destructive forces (e.g., tornadoes) as well as man-made destructive forces such as impact loads from projectiles and blasts associated with explosives detonations. These traditional building structures often are constructed of substantial thicknesses of reinforced concrete capable of withstanding the forces associated with the aforementioned loads. An obvious disadvantage of using concrete is its great weight, which makes it difficult to transport and assemble on site. Additionally, although concrete is capable of withstanding large forces or projectile impacts, extreme loading can cause concrete walls to spall, break apart, or be pushed over.

Building modules are known which comprise sheet metal in lieu of concrete and thus are relatively light. These known building modules may easily be prefabricated and transported to the building site for assembly. An example of such modules are those described in U.S. Pat. No. 4,928,468 to Phillips, the entirety of which disclosure is incorporated herein by reference. These building modules may contain thermo/acoustic insulation, or they may contain supplemental internal structures for preventing forcible entry. The structures in these modules may also prevent penetration of the associated building panel by low level ballistic projectiles.

Still some current building modules may be difficult to handle and transport due to their substantial size and weight, making their procurement and installation expensive and costly to heat and cool.

It would, therefore, be desirable to provide a lightweight, low cost building assembly that would resist and dissipate and carry the forces associated with projectiles or blasts to mitigate damage to the overall building structure.

The desired assembly should be versatile enough to be used in a wide variety of structural applications. In addition to the aforementioned blast or projectile resistance, such an assembly should provide substantial structural load-bearing strength to enable its use in any of a variety of building structures.

SUMMARY OF THE INVENTION

The disadvantages heretofore associated with the prior art are overcome by the inventive design for a building assembly that is lightweight, cost effective, and that provides enhanced protection from penetration due to projectiles and blasts.

The inventive assembly is designed to accept multiple local bendings without resulting in structural failure of the building in which the assembly is incorporated. Thus, a wall constructed in accordance with embodiments of the inventive assembly can sustain local bending from an explosive blast, but will retain sufficient structural integrity to remain intact, thus allowing evacuation of the occupants and continued use of the structure. Even where the blast force is sufficient to cause a breach of the inner wall, embodiments of the inventive assembly are still designed to maintain sufficient structural integrity to allow occupants to evacuate and contents to be evacuated, and to enable the building itself to be repaired and returned to full service.

Thus, a structural assembly for use in a building is disclosed, the structural assembly may comprise a building, module, wall, roof, column, beam, or floor. The assembly may comprise a first plate forming a first face sheet of the structural assembly, and a second plate forming a second face sheet of the structural assembly. Third and fourth plates may be positioned between the first and second plates and may be laterally offset with respect to each other, such that an end portion of the third plate may overlap an end portion of the fourth plate. A first flanged web member may connect the first plate to the third plate, and a second flanged web member may connect the second plate to the fourth plate. Further, the first and second flanged web members may be offset by a lateral distance.

A structural assembly is further disclosed, comprising first and second spaced apart plate members, and third and fourth plate members disposed between said first and second plate members. The third and fourth plate members may be laterally offset with respect to each other such that an end portion of the third plate member overlaps with an end portion of the fourth plate member. The structural assembly may comprise a building, module, wall, roof, column, beam, or floor. The assembly may further comprise first and second flanged webs, the first flanged web connecting the first and third plate members, and the second flanged web connecting the second and fourth plate members. The first and second flanged webs may be laterally offset with respect to each other.

A structural assembly is further disclosed, comprising: first and second facing panels; first and second interior panels; and first and second flanged webs. The first and second facing panels may be spaced apart by a distance sufficient to receive the first and second interior panels there-between, with the first facing panel connected to the first interior panel by the first flanged web, and the second facing panel connected to the second interior panel by the second flanged web. The first and second interior panels may be laterally offset with respect to each other such that only a portion of the first interior panel overlaps with a portion of the second panel. Additionally, the first and second flanged webs may be laterally offset with respect to each other.

In one embodiment, a structural assembly for use in constructing a building structure is provided, the assembly comprising a first face sheet and a second face sheet, wherein the second face sheet is substantially parallel to the first face sheet. A first internal support is provided which is connected to and extends inwardly from the first face sheet. A second internal support is connected to and extends inwardly from the second face sheet. The first internal support and the second internal support comprise a primary support member extending toward an opposing face sheet. The primary support members of the first internal support comprise a first end and a second end and a predetermined length therebetween. The first ends are provided proximal the first and second face sheets, respectively, and the second ends are provided proximal to each other. Each of the primary support members comprise at least one angled panel extending from the primary support member at a predetermined angle, the at least one angled panel adapted to contact the opposing primary support member when a portion of the assembly is deformed. The first internal support member and the second internal support member are provided in a spaced apart manner in a first position of use, the first position of use corresponding to a position wherein the assembly has not been deformed, and wherein the first internal support member and the second internal support member are provided in force transmitting communication with each other when at least one of the first and second face sheets are impacted by a force.

In another embodiment, a structural assembly for use in constructing a building structure is provided, the assembly comprising a first face sheet and a second face sheet, wherein the second face sheet is substantially parallel to the first face sheet. A first angled support member is connected to and extends inwardly from the first face sheet. A second angled support member is connected to and extends inwardly from the second face sheet. The first angled support member comprises at least one angled panel extending at an angle from the first angled support member. The at least one angled panel of the first angled support member comprises a first end secured to the first angled support member and a second end comprising a free end, and wherein the free end is adapted to contact the second angled support member when a portion of the assembly is deformed. The first angled support member and the second angled support member are provided in a spaced apart manner in a first position of use, the first position of use corresponding to a position wherein the assembly has not been deformed, and wherein the first angled support member and the second angled support member are provided in force transmitting communication with each other when at least one of the first and second face sheets are impacted by a force.

In another embodiment, a structural assembly for use in constructing a building structure is provided, the assembly comprising a first face sheet, a second face sheet, wherein the second face sheet is substantially parallel to and spaced apart from the first face sheet. A first internal support member is connected to and extends inwardly from the first face sheet. A second internal support member is connected to and extends inwardly from the second face sheet. The first internal support member comprises a first end secured to the first face sheet and a second end comprising a free end, and a length provided between the first end and the second end. The second internal support member comprises a first end secured to the first face sheet and a second end comprising a free end, and a length provided between the first end and the second end. An angled panel member is provided between the first end and the second of the first internal support member, the angled panel adapted to contact the second end of the second internal support member upon a deformation of the assembly. The first internal support member and the second internal support member are provided in a spaced apart manner in a first position of use, the first position of use corresponding to a position wherein the assembly has not been deformed, and wherein the first internal support member and the second internal support member are provided in force transmitting communication with each other when at least one of the first and second face sheets are impacted by a force.

DESCRIPTION OF THE DRAWINGS

The details of the invention may be obtained by a review of the accompanying drawings, in which like reference numerals refer to like parts, and in which.

DETAILED DESCRIPTION

A new structural assembly is disclosed for use in building applications in which a high resistance to large explosive blasts, projectile impact loads, high speed vehicle impacts, forced entry or exit, and the like, is desired. The structural assembly design incorporates a pair of outer face sheets, spaced apart to form a void there between. Within the void is a plurality of particularly situated and oriented structural members configured to resist and mitigate by dissipating explosive blast or projectile loads applied to one of the outer wall faces. The internal structural members are designed and positioned to bend in response to such loads, thereby minimizing the chance that one or both of the external faces will be breached. In addition to breach-prevention, the new structural assembly design also will maintain the structural integrity of the building for sufficient time to enable the occupants to evacuate, to enable the contents to be evacuated, and to allow the building to be repaired and reused.

Thus, embodiments of the present invention provide for inward movement of one of the outer faces (typically the face (e.g., building, module, wall, roof, column, beam, or floor) that is closest to the explosive blast or projectile impact), to thereby dissipate and carry forces rather than to completely withstand it. For cases in which the blast or projectile are of such magnitude that the assembly (wall, roof, floor, etc.) is penetrated, sufficient structural integrity is maintained to allow the occupants to safely evacuate, the contents of the building to be removed, and the building to be repaired and reused.

Before specific embodiments of the present disclosure are described, it should be noted that sheets and structural assemblies of the present disclosure are intended to protect building components (e.g., walls, including both load bearing and non-load bearing), both internal or external, from forced entry or exit by people and/or breach by physical objects such as, for example, cars, trucks, including construction vehicles and the like, military vehicles, projectiles and explosive devices. Any type of building, the walls of which may be subject to breach due to forced entry or exit or natural (e.g., earthquake) or man-made (e.g., explosions, including hostile and accidental) forces, is suitable for use with structures of the present disclosure. Examples of buildings in which structures of the present disclosure may be incorporated include, but are not limited to, schools, residential buildings, commercial buildings, jails, detention centers, prisons, government buildings, and military buildings.

Figure 1:
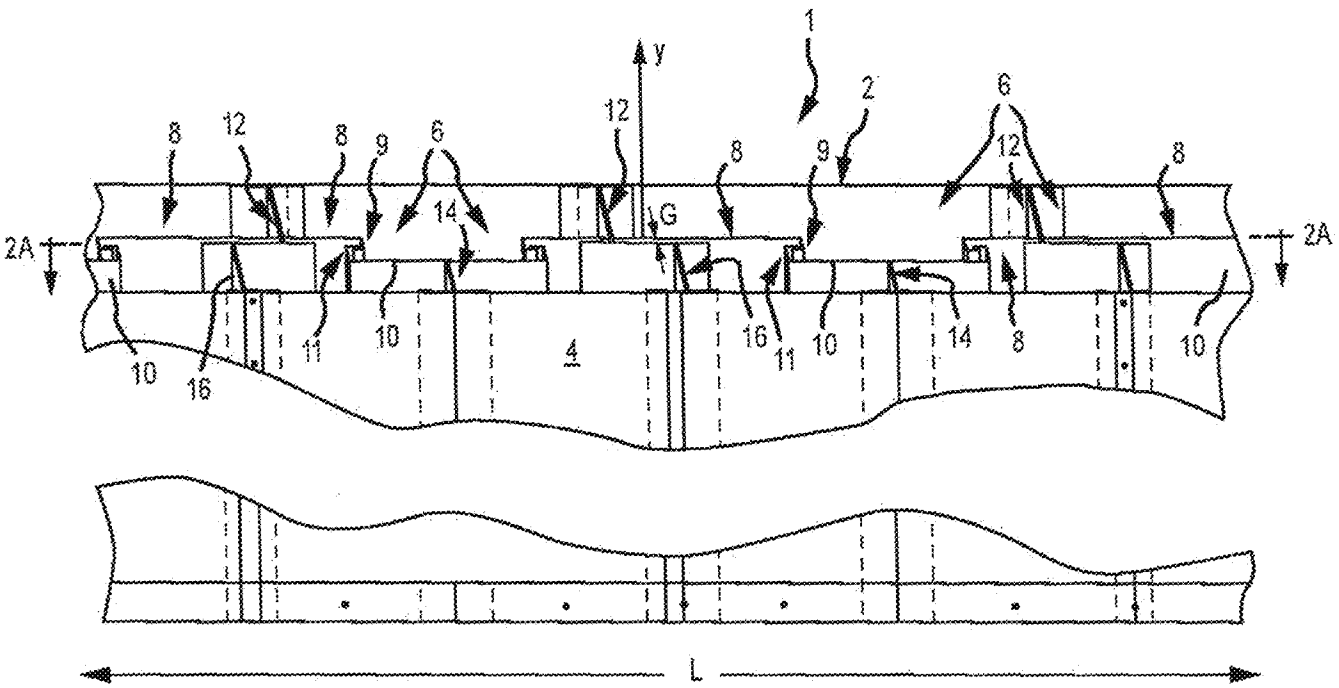
FIG. 1. is an isometric cutaway view of a portion of an exemplary structural assembly according to one embodiment of the invention.
Figure 2A:
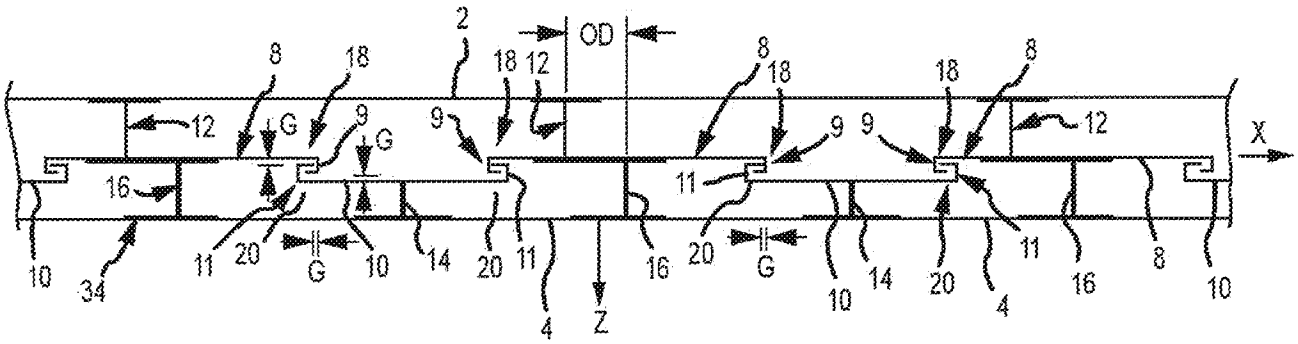
FIG. 2A is a cross-section view taken along line 2A of FIG. 1.

Referring to FIGS. 1 and 2A, an exemplary structural assembly 1 is shown. The structural assembly 1 may comprise a wall, module, floor/ceiling, roof, column, beam, or building section. The structural assembly 1 may be prefabricated at the factory in a modular fashion that can then be fully assembled at the installation site. The structural assembly 1 is shown as having first and second face sheets 2, 4, and a plurality of internal structural members 6 configured to provide strength and stability to the assembly 1 to support the typical vertical and horizontal loads associated with a building structure. In various embodiments, the internal structural members 6 comprise a plurality of individual vertically positioned sheet elements having portions oriented either substantially parallel to, and/or substantially perpendicular to, the first and second face sheets 2, 4. It will be appreciated that although the internal structural members 6 are shown in the figures as being oriented parallel and/or perpendicular to the first and second face sheets 2, 4, one or more of the members could be oriented so as to be obliquely angled with respect to the face sheets 2, 4.

As noted, the structural assembly 1 comprises complete and continuous floors, walls, roofs and buildings having the disclosed arrangement of face sheets 2, 4 and internal structural members 6 in various embodiments. The structural assembly 1 is manufactured in at least one of a variety of sizes, depending upon what the installation equipment and site conditions will allow. Thus, for some applications, the structural assembly 1 is pre-manufactured at the factory to comprise an entire floor, wall, roof or building and then shipped to the site for installation. In other applications, such as for retrofit applications, the assembly is manufactured in discrete modules at the factory, shipped to the installation site, transported into the building and fastened together to form a larger overall assembly 1.

In the embodiments depicted in FIGS. 1-2A, the internal structural members 6 comprise a plurality of opposing intermediate panels 8, 10 oriented substantially parallel to the first and second face sheets 2, 4, as well as a plurality of flanged web members 12, 14 oriented substantially perpendicular to the first and second face sheets. Each of the intermediate panels 8, 10 is connected to one of the first and second face sheets 2, 4 by an associated flanged web member 12, 14. As shown, the opposing intermediate panels 8, 10 are alternately positioned along the length "L" of the assembly 1 so that immediately adjacent panels 8, 10 are connected to different face sheets 2, 4. The immediately adjacent intermediate panels 8, 10 also are linked to each other by channel shaped members 9, 11 formed at the distal edges of each intermediate panel 8, 10.

In certain embodiments, the structural assembly 1 further comprises additional supportive flanged web members 16 positioned opposite to some of the intermediate panels. In the illustrated embodiment of FIG. 2A, these additional flanged web members 16 are positioned opposite to intermediate panels 8 and are directly connected to the second face sheet 4. The additional flanged web members 16 are positioned so that they are laterally offset along the X-axis (by "OD" (FIG. 2A)) from the flanged web members 12 that connect the intermediate panel 8 to the first face sheet 2. This lateral offset forms a cantilever arrangement in which intermediate panel 8 is supported by two opposing but offset flanged web members (12, 16). Thus, when a load is applied to the second face sheet 4 (the one to which flanged web member 16 is attached), the load is carried from the face sheet 4, through the flanged web member 16, to intermediate panel 8, such that panel 8 bends, but is restrained at each end by the channel shaped members 9, 11 and also by flanged web member 12 near the center of the structural assembly 1 (see FIG. 3B). This bending of intermediate panel 8 (and also intermediate panel 10, as the channel shaped members 9, 11 interlock) dissipates and carries the blast forces throughout the interior structure of the assembly and to the foundation.

It will be appreciated that where the structural assembly 1 comprises a complete wall, floor, roof, column, beam, or building, that the reaction to an explosive blast will be substantially the same all the way along the length of the assembly, since the arrangement of the flanged web clusters (i.e., those formed by flanged web members 12 and 16) and the interlocking channel shaped members 9, 11 is carried throughout the assembly, as will be described in greater detail. Thus, the flanged web cluster and channel shaped member arrangement serves to effectively dissipate a blast throughout the interior structure to minimize the chance that any of the structural members will fail, at the same time, carrying a substantial portion of the horizontal and vertical blast force to the foundation.

The additional flanged web members 16 do not directly contact the intermediate panels 8 in preferred embodiments and during normal use and/or positioning of the assembly 1. Rather, members 16 are offset from the intermediate panels 8 by a gap such that the additional flanged web members 16 only contact the intermediate panels 8 when an explosive blast or projectile impact load is applied to one of the first or second face sheets 2, 4. This offset enhances the thermal and acoustical efficiency of the structural assembly 1 by eliminating a direct metal-to-metal contact path between the first and second face sheets 2, 4. Additionally, insulation material or epoxy may be provided within the gap to further enhance the thermal and acoustical efficiency of the structural assembly 1. Thus, the gap is preferably of sufficient size to allow for the installation of a desired thickness of thermal insulation, acoustic insulation or epoxy.

Thus configured, the internal arrangement of the structural assembly 1 provides for efficient dissipation and carriage of forces in response to a blast or projectile impact load applied to one of the external faces 2, 4. For example, when an explosive blast or projectile impact load of sufficient force is applied to the first or second face sheets 2,4, the portion of the assembly immediately adjacent to the flanged web clusters (12, 16) remains substantially rigid, while the intermediate panel 8, 10 associated with the impacted face sheet moves toward the opposing intermediate panel, causing the channel shaped members 9, 11 to engage. The engagement of the channel shapes prevents the face sheet 2 (with its associated flanged web member 12 and intermediate panel 8) from completely separating from face sheet 4 (with its associated flanged web member 14 and intermediate panel 10), during a blast or projectile impact. Interlocking also connects the intermediate panels 8, 10 to the immediately adjacent flanged web clusters 12, 16, thus providing support and facilitating the efficient carriage of force between the face sheets 2,4 and the intermediate panels 8, 10. The bending of the intermediate panels 8, 10 and face sheets 2,4 substantially dissipates the forces from explosive blast and projectile impacts, thus maintaining sufficient structural integrity in the structure to allow occupants to evacuate and contents to be evacuated, and to enable the building itself to be repaired and returned to full service.

Figure 3A:
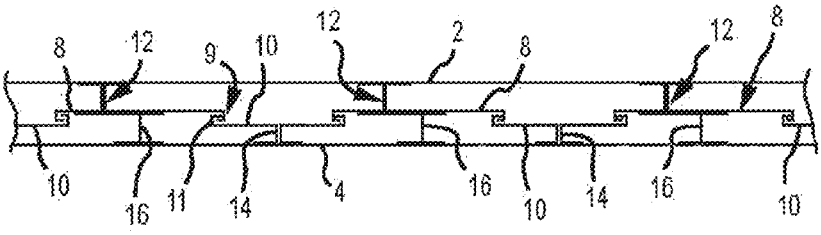
FIGS. 3A-3C are cross-section views of the structural assembly of FIG. 1, before, during and after a blast has been applied to one of the assembly faces respectively.
Figure 3B:
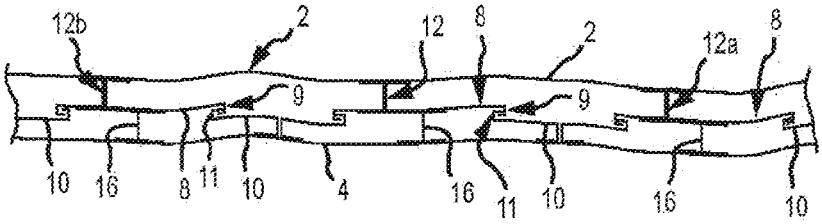
Figure 3C:
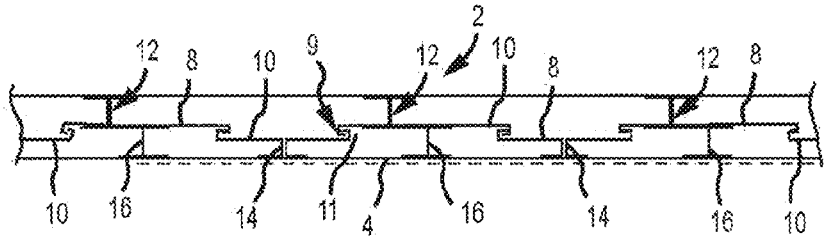

An example of how the internal structures of the structural assembly 1 react in response to an applied blast is shown in FIGS. 3A-3C. Although these figures show only a portion of the structural assembly 1, it will be appreciated that the response to a blast will generally be consistent along the entire length, width and height of a full structural assembly 1. FIG. 3A shows the assembly 1 configuration prior to the blast. FIG. 3B shows the assembly 1 configuration during application of a blast to the second face sheet 4. As can be seen in FIG. 3B, the second face sheet 4 is substantially bent inward toward the first face sheet 2 at a point located between the flanged web clusters 12, 16. This bending partially dissipates and carries the blast, moving flanged web members 14 and intermediate panel 10 inward until the channel shaped members 9, 11 interlock intermediate panels 10 with intermediate panels 8 to carry the load throughout the assembly 1 and to the foundation of the building in which it is incorporated. As noted, the points of maximum movement can be seen to be the mid-points of face sheets 2, 4 between the flanged web clusters 12, 16. These points may be "designed-in" to the module, for example, by designing the channel shaped members 9, 11 to be less resistant to deflection as compared to the surrounding structural members, by adjusting the length of the flange(s) on the flanged web members 16, or by using lighter gauge steel at or near the point at which maximum deflection is desired. FIG. 3C shows the post-blast configuration in which the first and second face sheets 2, 4 and some of the internal structures (intermediate panels 8, 10; channel shaped members 9, 11) have been permanently bent. It can be seen that although these internal structures have been bent, the structural assembly 1 has not been breached, and none of the interconnections between structural members has completely failed.

The structural assembly 1 may be oriented to protect the inside as well as the outside of the building. In various embodiments, structures of the present disclosure are arranged to protect the building from internal blasts, such as where the building is an armory, a chemical plant, or the like.

Figure 4A:
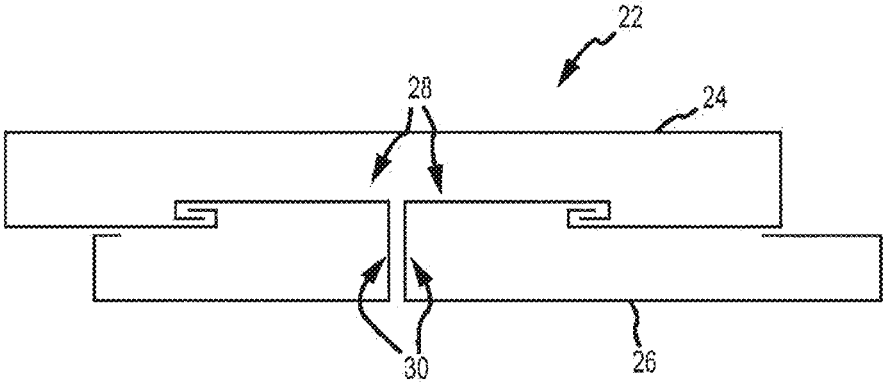
FIG. 4A is a cross-section view of a conventional structural module.
Figure 4B:
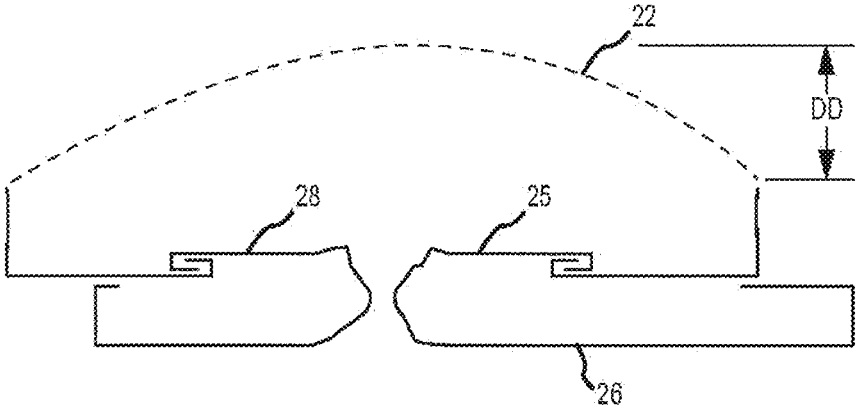
FIG. 4B is a cross-section view of the conventional structural module of FIG. 4A after being subjected to an explosive blast.

This is in sharp contrast to conventional building module designs, one of which is illustrated in FIGS. 4A and 4B. As can be seen in FIG. 4A, conventional module 22 has inner and outer face sheets 24, 26, and an interior panel 28 supported by a single flanged web member 30. In response to an explosive blast force directed at the outer face 26, the outer face sheet 26, interior panel 28 and flanged web member 30 are breached, and substantial deformation (denoted as "DD") of the inner face sheet 24 occurs.

As previously noted, the structural assembly 1 may be used in retrofit applications in which an existing wall, floor, roof or portion of an existing building requires blast or projectile impact protection. In such applications, the confines of the existing building prevents the installation of large assemblies 1 (i.e., full walls, roofs or floors), and thus the assembly is manufactured in discrete modules, shipped to the installation site, transported into the building and joined together to form a larger overall assembly 1.

Figure 2B:
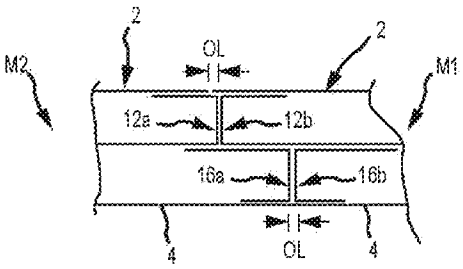
FIG. 2B is a detail view of a portion of FIG. 2A showing the interconnection of adjacent assemblies, for embodiments in which the assemblies are provided in modular form.

In various embodiments, adjacent modules are fixed together using any suitable connection method, such as welding, gluing, bolting, and the like. An example of how adjacent modules may be fixed together is shown in FIG. 2B, wherein adjacent modules M1, M2 are provided with slightly overlapping face sheets 2, 4 (e.g., the face sheets 2, 4 of one module may overlap the adjacent panel by a distance shown as "OL"). This enables the face sheet of the first module M1 to be overlapped and connected to the adjacent module M2. It will be appreciated that where one or more face sheets 2, 4 overlap an adjacent module, the overlapped portion of that adjacent module will be provided without a face sheet. This ensures an even finished external surface configuration for the finished joined modules. Again, this overlapped face sheet approach may only be required for retrofitting applications.

Figure 2C:
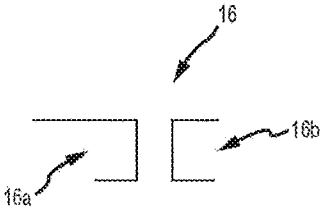
FIGS. 2C and 2D are a cross-section views of the individual load bearing sheet members that make up a portion of the structural assembly of FIG. 1.
Figure 2D:
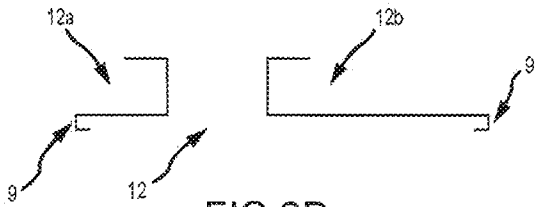

FIGS. 2C and 2D depict individual flanged web members 12, 16 formed by the conjunction of a pair of wide-flange channels 12*a, b*; 16*a, b*. Initially, the individual channels are formed from appropriately sized sheets of steel (or other material), which are formed into the channel shapes shown in the figures. The channels 12*a, b*; 16*a, b* are then connected to form the individual flanged web members 12, 16 by welding, gluing or other appropriate technique. Although not shown, it will be appreciated that flanged web member 14 can be constructed in much the same manner.

As previously noted, the internal arrangement of structural members within the structural assembly 1 is repeated throughout the assembly, and thus the force dissipating flanged web clusters 12, 16 and interlocking features 9, 11 are carried throughout the entire assembly. This will also be true for retrofit applications, in which individual modules are formed and joined together at the installation site. Thus, the multiple flanged web clusters are formed throughout the assembly when multiple individual modules are joined together, enabling the invention to be applied to buildings of virtually any size.

As previously noted, the end regions 18, 20 (FIG. 2A) of each of the intermediate panels 8, 10 comprise corresponding channel shaped members 9, 11 which allow adjacent internal panels 8, 10 to interlock when the panels 8, 10 bend in response to an explosive blast or projectile impact. As shown in FIG. 2A, these channel shaped members 9, 11 may be separated on all sides from each other by a gap "G," in order to minimize the transmission of thermal and acoustical energy between the face sheets 2, 4. These gaps "G" may also be formed between adjacent internal panels 8, 10, again, to reduce total thermal and acoustical energy transmission between the first and second face sheets 2, 4 of the structural assembly 1. Providing these gaps "G" controls the conduction of heat and sound between the first and second face sheets 2, 4. Such gaps may reduce heating/cooling costs associated with daily operation of a building formed in whole or in part by the structural assembly 1. Further improvements are provided wherein one of the face sheets 2, 4 is subjected to fire or source of extreme heat, as the amount of time required to heat up the opposite face sheet is increased, thereby enabling the building to retain sufficient structural integrity to allow occupants to evacuate and contents to be evacuated, and to enable the building itself to be repaired and returned to full service. Such gaps may also reduces the transmission of sound through the structure, which may be desirable in embodiments in which the building comprising the disclosed structures house a large number of people such as, for example, a jail, prison or detention center.

It is noted that the channel shaped members 9, 11 also serve to hold the first and second face sheets 2, 4 together when one of the face sheets is subjected to heat of sufficient magnitude that it weakens a portion of one of the structural assembly and its associated structural members. This is important where building integrity must be maintained for a sufficient time to enable the occupants to evacuate and contents to be evacuated.

In various embodiments, the gaps "G" are filled with one or more insulation material, epoxy or other filler materials to further reduce the conduction, or transfer, of heat or sound across the structural assembly 1. Any insulation material can be used to fill the gaps "G", so long as they have characteristics suitable for reducing, or preventing, transmission of energy (e.g., thermal, acoustic, electronic) while not comprising the functional integrity of the disclosed structure. Examples of useful materials include, but are not limited to, fiberglass, vinyl, mineral wool, polyurethane, foam, aerogel, cellulose, paper and the like. In some embodiments, a single type of insulation material, epoxy or other filler materials may be used. In some embodiments, a single structural panel my include more than one type of insulation material, epoxy or filler materials. Suitable insulation materials, epoxies, filler materials and mixtures thereof for preventing the transmission of particular energies are known to those skilled in the art. It will be appreciated, however, that providing gaps between these structures is not critical, and thus, the structural assembly 1 may be formed without such gaps.

In further embodiments, the structural assembly 1 is filled with foamed and/or blown insulation, or precut and formed insulation material or board, to enhance the overall thermal and acoustical efficiency of the building of which it is a part. Other materials also may be provided in the space between face sheets 2, 4, such as a material appropriate to the specific requirements of the building to provide the assembly with additional mass and resistance to blast or projectile impacts. Additionally, where prevention or inhibition of electronic eavesdropping is desired, the assembly 1 is partially or completely filled with shredded copper or other appropriate material. Other filler materials include, but are not limited to, copper steel slag filler material (mineral wool and silica), fire resistant insulation, or impact resistant insulation. Additionally, impact resistant insulation such as fiberboard may be applied to one or more surfaces within the assembly. Such impact resistant insulation substantially enhances the assembly's resistance to crushing.

Sheets of the present disclosure may be cut to various user-desired sizes, and bent into the appropriate form to impart desired structural features, and then connected to form site specific structural assemblies 1 (e.g., walls, roofs, columns, beams, floors) which are ultimately formed into a complete building structure. It should be appreciated that a particular structural assembly may be comprised of sheets of the same size or sheets of various sizes, depending on the application being addressed. Likewise, the sizes of different structural assemblies may vary depending on their intended use, even though multiple structural assemblies of various sizes may use sheets of the same size. Thus, for example, a single floor, wall, etc may contain sheets of various sizes and in fact, may itself be made of several structural assemblies, each of which contains sheets of the same, or different, sizes.

Further, the structural assembly 1 (e.g., walls, roofs, columns, beams, floors) can be manufactured at the factory in a size as large as the installation equipment and site conditions will allow. When used in a retrofit application, smaller, discrete modules are be manufactured and delivered to the site for assembly with one or more other discrete modules. In one embodiment of the retrofit application, the individual structural elements that form a module are formed and shipped to the installation site as individual pieces or sub-modules where they may be joined together to construct one or more modules. This provides the advantage(s) in that it enables the inventive structural assembly 1 to be transported and installed anywhere in the world, and minimizes or eliminates problems associated with long-range shipping of oversized loads. Additionally, these features enable unobtrusive installation of the modules for reinforcing all or part of existing buildings. Such unobtrusive installation has the benefit of enabling discreet installation, for example, in protecting classified domestic or foreign building installations or portions thereof.

In various embodiments, structural assemblies of the present disclosure may be formed on-site through the use of one or more portable or semi-portable forming machines. For example, where larger jobs require various structural assemblies in accordance with the present disclosure, the provision of on-site forming machines is contemplated to provide ease of access and rapid construction of the appropriate structural unit.

Any desired fabrication/shipping method may be used, and, as noted, the decision about which method to undertake is based on site-specific requirements, such as the size of the installation equipment and the space available for installation. For example, in new construction applications it may be more cost-effective and efficient to fabricate an entire structural assembly 1 (walls, roofs, floors, columns, beams, etc.) at the factory and ship them to the installation site. For retrofit applications, however, it may only be practical to fabricate and transport relatively smaller modules that can be hand carried into existing building structures for assembly.

Referring to FIGS. 5A through 5E, exemplary steps are shown for fabricating a portion of the inventive structural assembly 1 of FIG. 1. As previously noted, the structural assembly 1 (here shown as an individual module) may be assembled from a plurality of individual sheet steel sub-units 36*a*, 36*b*, 38*a*, 38*b*, which have been cut and bent to have a desired shape. The individual sub-units may themselves be made of one or more pre-shaped individual pieces which are then joined together (via welding, gluing or the like) to form the desired structural assembly 1. As noted, the entire manufacturing process can be performed prior to shipping, or sub-units or modules may be manufactured and shipped and then joined at the installation site.

Figure 5A:
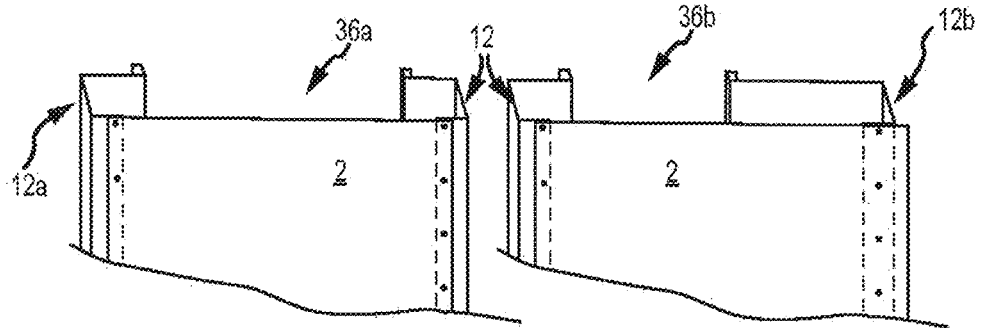
FIGS. 5A-5E are isometric cutaway views of a series of exemplary steps for assembling the structural, assembly of FIG. 1.
Figure 5B:
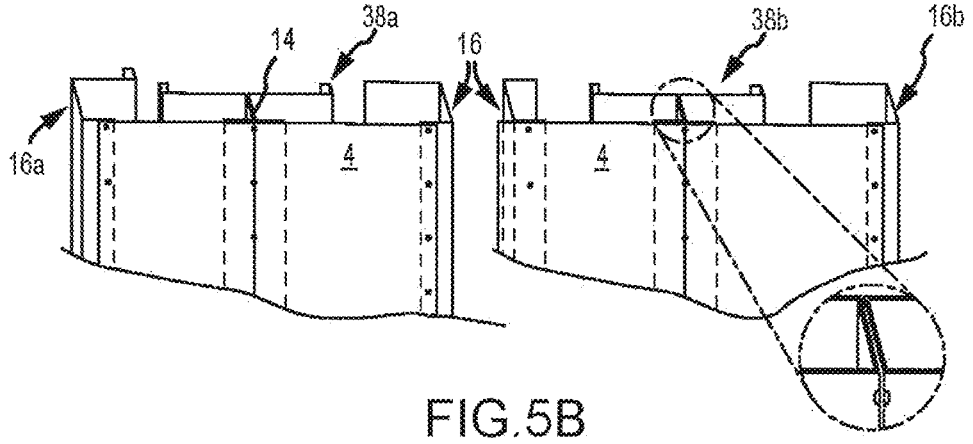

FIG. 5A shows the fabrication of a pair of sub-assemblies 36*a*, 36*b* that comprise the first face sheet 2 and its associated flanged web members 12, 12*a*, 12*b*. In the illustrated embodiment, the individual sheet elements comprise flanged web members 12, 12*a*, 12*b* which are joined to the panel face sheet 2 via welding or fastening. FIG. 5B similarly shows the fabrication of a pair of subassemblies 38*a*, 38*b* that comprise the second face sheet 4 and its associated flanged web members 14, as well as the additional supportive flanged web members 16, 16*a*, 16*b*. The individual sheet elements comprising the flanged web members are joined to the face sheet 4 via welding or fastening. It will be appreciated, however, that joining techniques other than welds may also be used (e.g., gluing, mechanical fasteners, use of double-sided adhesive strips).

Figure 5C:
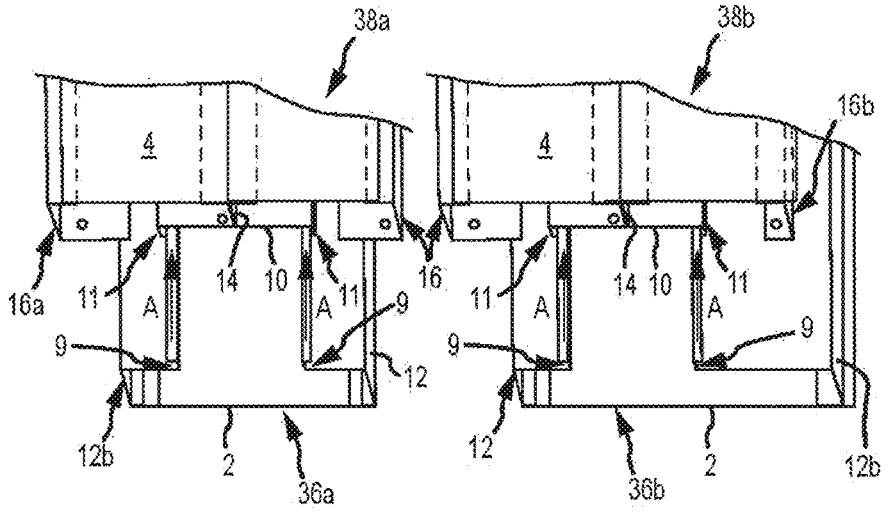

FIG. 5C shows the fit-up of sub-assemblies 36*a*, 38*a* and 36*b*, 38*b*. As can be seen, the respective sub-assemblies (36*a*, 38*a*; 36*b*, 38*b*) are positioned end-to-end so that their respective channel shaped members 9, 11 align. The sub-assemblies are then placed together in an interlocking position, with sub-assemblies 36*a*, 36*b* moving with respect to sub-assemblies 38*a*, 38*b* in the direction of arrows "A." The sub-assemblies 36*a*, 38*a* and 36*b*, 38*b* may form larger sub-assemblies 40*a*, 40*b*.

Figure 5D:
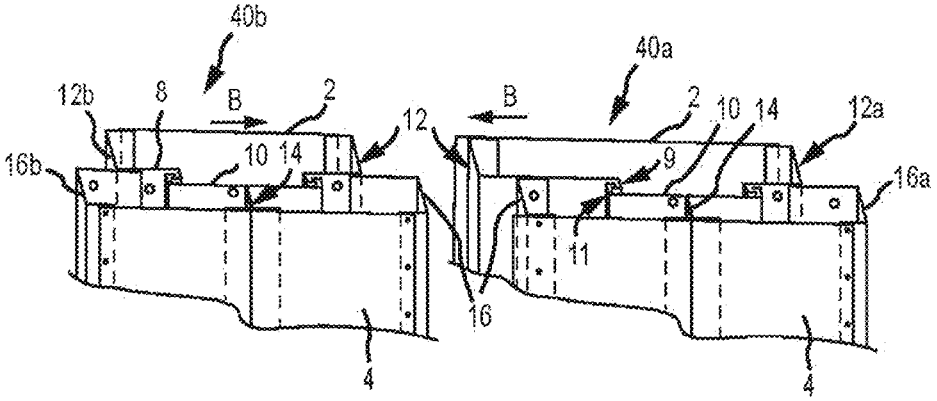
Figure 5E:
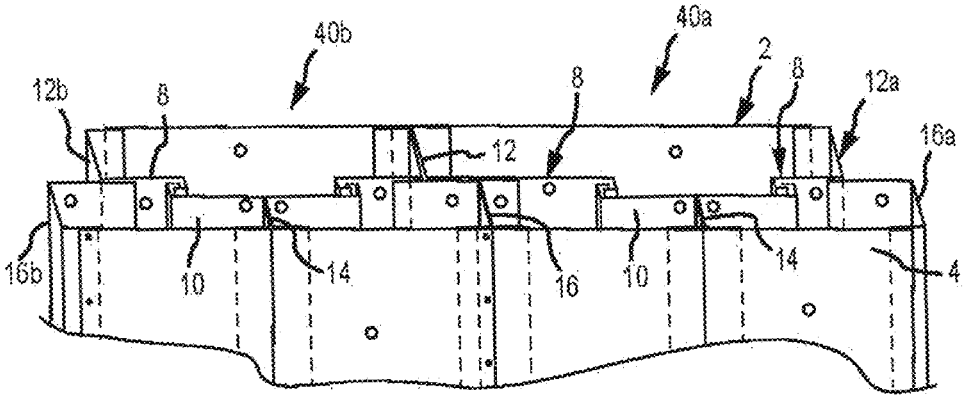

Larger sub-assemblies 40*a*, 40*b* are then moved together (along respective arrows "B") as shown in FIG. 5D. FIG. 5E shows the sub-assemblies 40*a*, 40*b* in the engaged position, whereupon they may be joined together. Completed flanged web members 12, 14 and 16, as well as their sub components 12*a*, 12*b*, 16*a*, 16*b*, can be seen in the engaged assembly.

The completed module shown in FIG. 5E may then be joined to other such modules to form a completed wall, roof, floor or building, as desired. Alternatively, a single module may be used to protect a discrete portion of a wall, roof, column, beam, or floor.

Figure 6:
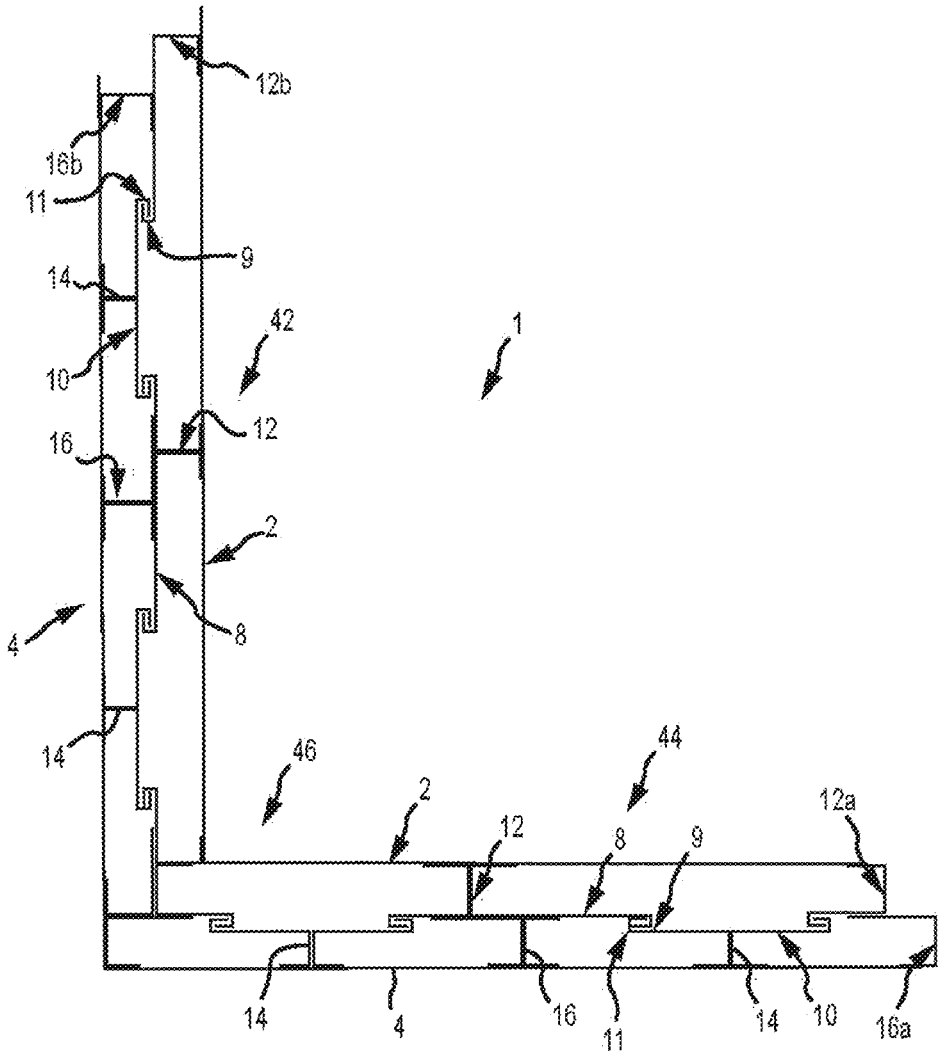
FIG. 6 is a cross-section view of a portion of an exemplary structural assembly according to the invention in which the assembly comprises a portion of two walls of a building structure.

Referring now to FIG. 6, structural assembly 1 is shown in a cross-sectional top plan view, the assembly comprising a pair of walls 42, 44 joined at a corner 46. As can be seen, the internal arrangement of structural members within the structural assembly 1 of FIG. 6 is the same as previously described in relation to FIGS. 1 and 2A. Thus, the specified arrangement of flanged webs 12, 14, 16, channel shaped members 9, 11 and intermediate panels 8, 10, is repeated throughout the assembly 1, and thus the force dissipating flanged web clusters 12, 16 and interlocking features 9, 11 are carried throughout the entire assembly 1. As before, the flanged web cluster and channel shaped member arrangement shown in FIG. 6 serve to effectively dissipate a blast throughout the interior structure of both walls 42, 44 to minimize the chance that any of the structural members will fail. It will be appreciated that this structural scheme can be repeated to obtain a unitized wall, floor, column, beam, panel, roof or building in any of a wide variety of sizes.

Although welding has been described for use in joining the individual elements that make up the finished structural assembly 1, other joining techniques may also be used to connect some or all of the sub-units together. For example, one or more of the sub-units may be glued together, such as with an appropriate high-strength epoxy. Alternatively, a combination of epoxy and welding techniques may be used. Thus, in one embodiment, a low-modulus, high-strength epoxy is used in combination with welding to connect the flanged web member subcomponents (12*a*, 12*b*; 14, 16*a*, 16*b*). Epoxy may also be used to strengthen corner members, which may be subjected to extreme loading during an explosive blast or projectile impact.

In addition to its use in fixing individual elements of the structural assembly 1 together, a layer of epoxy may also be provided over one or more interior surfaces of the assembly 1 to increase strength and enhance the energy dissipating characteristics of the assembly. Further, a layer of impact resistant insulation may be applied to one or more interior surfaces of the structural assembly 1.

The individual structures used to fabricate the structural assembly 1 may be any of a variety of appropriate materials known for use in structural building applications. In one embodiment, cold drawn sheet steel is provided. Alternatively, some or all of the structural members are made from other metals or a suitable non-metallic material such as PVC, vinyl, etc. Moreover, if a structure contains an insulating material, a single structure can contain a mixture of different types of material (e.g., metal, PVC, etc.) and insulating material (e.g., fiberglass, foam, etc.). Various combinations of such materials are also provided in further embodiments.

The inventive module comprises a modular, lightweight, and cost effective building system that can be used in a variety of applications, including blast walls, safe rooms, hurricane shelters, vandal-resistant garage or storage structures, and the like. It can be applied to existing buildings, as well as new construction, for virtually any structure that requires higher security than can be provided with commercial construction techniques.

Figure 7:
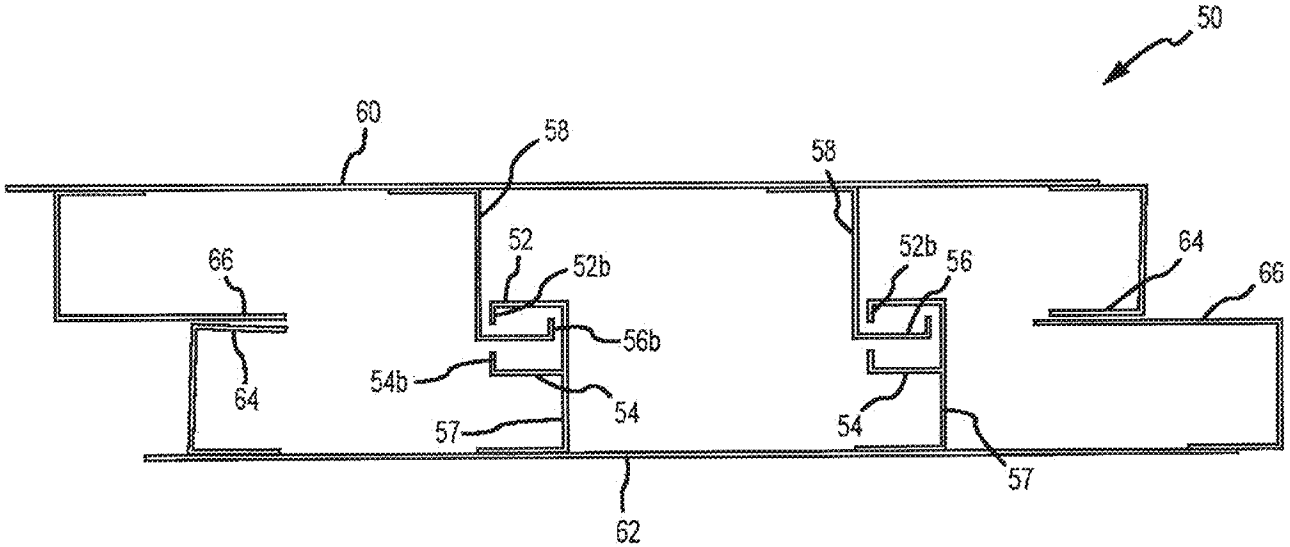
FIG. 7 is a cross-sectional view of a structural assembly according to one embodiment.

Referring now to FIG. 7, a structural assembly 50 according to one embodiment is shown in a cross-sectional top plan view. The depicted embodiment provides various features and benefits of additional embodiments of the present disclosure, and provides improved blast resistance in part due to structure of channel shaped members 52, 54, 56.

The structural assembly 50 of FIG. 7 comprises a wall, a floor/ceiling, a column, a panel, a beam, a roof, or a building section, to name a few. The structural assembly 50 may be pre-fabricated at the factory in a modular fashion that can then be fully assembled at the installation site. The structural assembly 50 is shown having first and second face sheets 60, 62, and a plurality of internal structural members configured to provide strength and stability to the assembly 50 to support the typical vertical and horizontal loads associated with a building structure. In various embodiments, the internal structural members 57, 58 comprise a plurality of individual vertically positioned sheet elements having portions oriented either substantially parallel to, or substantially perpendicular to, the first and second face sheets 60, 62. It will be appreciated that although the internal structural members are shown in the figures as being oriented parallel or perpendicular to the first and second face sheets 60, 62, one or more of the members could be oriented so as to be obliquely angled with respect to the face sheets 60, 62.

In various embodiments, the structural assembly 50 comprises complete and continuous structures having the disclosed arrangement of face sheets 60, 62 and internal structural members 57, 58. The structural assembly 50 is manufactured in at least one of a variety of sizes, depending upon what the installation equipment and site conditions will allow. Thus, for some applications, the structural assembly 50 is pre-manufactured at the factory to comprise an entire floor, wall, roof or building and then shipped to the site for installation. In certain applications, such as for retrofit applications, the assembly is manufactured in discrete modules at the factory, shipped to the installation site, transported into the building and fastened together to form a larger overall assembly 50.

In the embodiment depicted in FIG. 7, the internal structural members comprise a plurality of opposing intermediate panels 64, 66 oriented substantially parallel to the first and second face sheets 60, 62, as well as a plurality of flanged web members 52, 54, 56 oriented substantially perpendicular to the first and second face sheets. As shown, the opposing intermediate panels 64, 66 are positioned along a length of the assembly 50 so that immediately adjacent panels 64, 66 are connected to different face sheets 60, 62.

In order to connect adjacent panels, sections are spaced apart and butt welded to each other. For example, a prefabricated assembly 50 is connected to one or more additional prefabricated sections by providing the assemblies in close proximity and butt welding the assemblies together.

Figure 8:
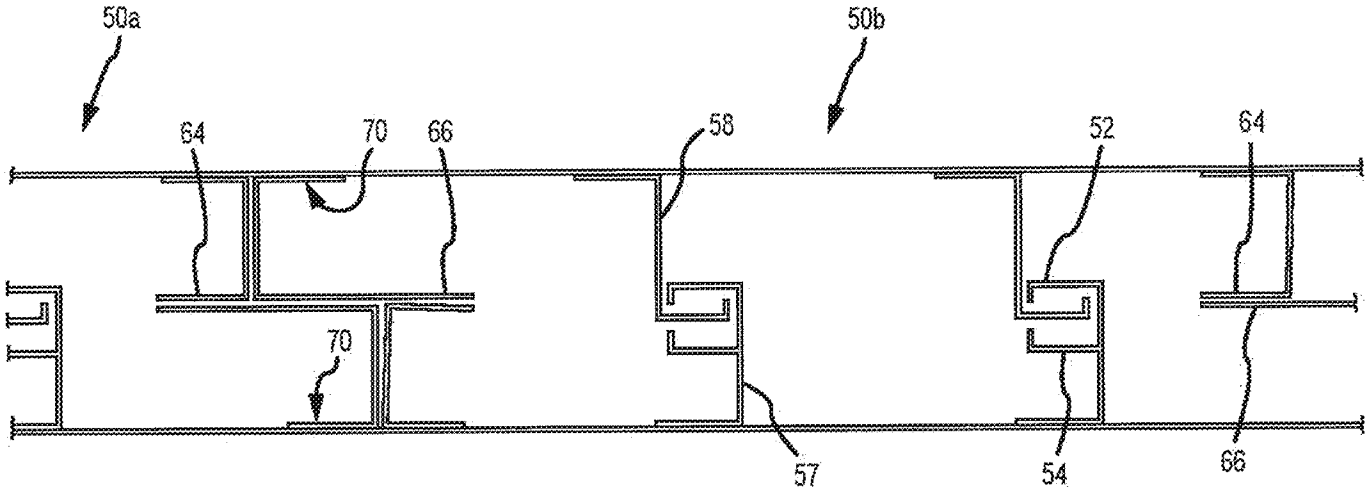
FIG. 8 is a top cross-sectional view of a structural assembly according to one embodiment.

FIG. 8 depicts adjacent assemblies 50*a*, 50*b* of the present disclosure. As shown, adjacent assemblies comprise various features as shown and described herein. Adjacent assemblies 50*a*, 50*b* are joined at two or more internal members 64, 66, 70, with opposing face sheets spaced apart and welded together through, for example, one or more butt welds.

An infinite wall can thus be fabricated at almost any desired width or height as may be desired. In various embodiments, a wall is provided with a width of between approximately three inches and approximately eighty inches. In more preferred embodiments, a wall may be provided with a width of between approximately six inches and approximately forty inches.

In certain embodiments, the structural assembly 50 comprises at least two flanged members 52, 54 extending substantially perpendicularly from internal structural members 57 and at least one flanged member 56 extending substantially perpendicularly from internal structural members 58. Flanged members 52, 54 extend generally perpendicularly from structural member 57 toward structural member 58 and further comprise secondary flanged members 52*b*, 54*b*, respectively. In various embodiments, secondary flanged members 52*b*, 54*b* extend substantially perpendicularly from flanged members 52, 54 and extend toward flanged member 56. Flanged member 56 is disposed generally between additional flanged members 52, 54 and, in one embodiment, is provided approximately at a mid-point between flanged members 52, 54.

Thus, when a load is applied to the second face sheet 62 (the one to which internal structural member 57 is attached), the load is carried from the face sheet 62, through structural member 57 to the flanged members which absorb energy from the load.

Flanged members 52*b*, 54*b* and 56*b* provide a substantially interlocking arrangement for improved blast and fire resistance. At least one of flanged members 52*b*, 54*b* and 56*b* are provided to engage at least one other flanged member 52*b*, 54*b* and 56*b* regardless of the specific direction and/or vector of force that is applied to the assembly.

It will be appreciated that where the structural assembly 50 comprises a complete wall, floor, roof, or building, that the reaction to an explosive blast will be substantially the same all the way along the length of the assembly, since the arrangement of the flanged web clusters is carried throughout the assembly. Thus, the flanged web clusters and channel shaped member arrangements serve to effectively dissipate a blast throughout the interior structure to minimize the chance that any of the structural members will fail, at the same time, carrying a substantial portion of the horizontal and vertical blast force to the foundation.

Figure 9:
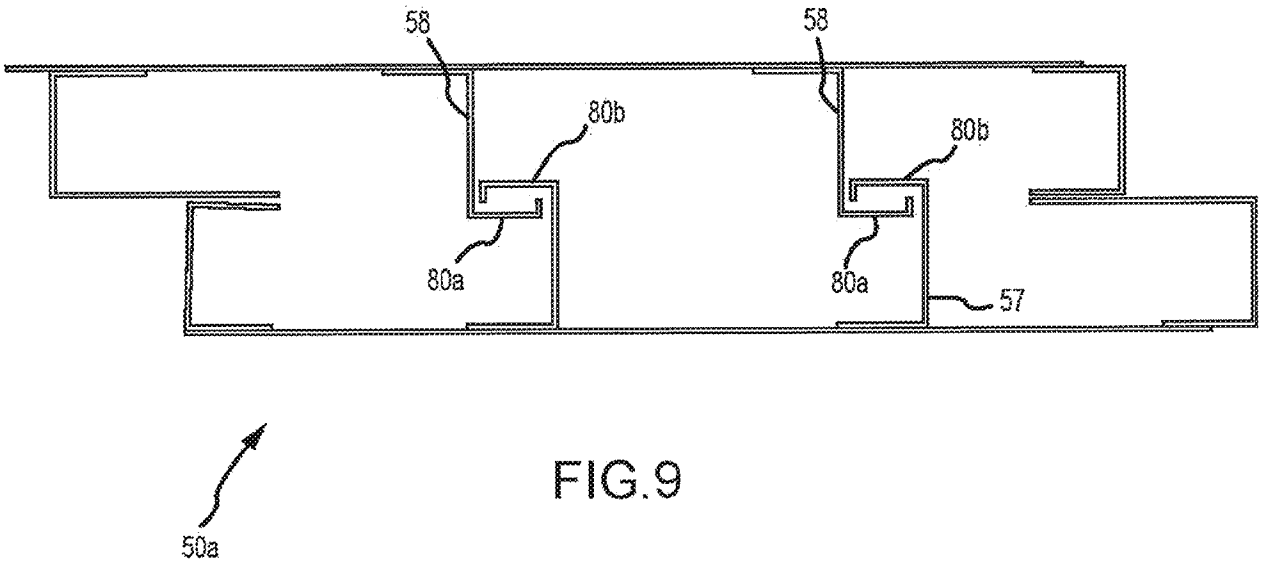
FIG. 9 is a top cross-sectional view of a structural assembly according to one embodiment.

FIG. 9 provides yet another embodiment of the present disclosure wherein an assembly is provided comprising two channel shaped members 57, 58 and two respective flanged members 80*a*, 80*b*. The assembly 50*a* of the embodiment provided in FIG. 9 comprises various features of the embodiment provided in FIGS. 7-8. As shown in FIG. 9, a plurality of channel shaped members 57, 58 and a plurality of flanged web members 80*a*, 80*b* are provided and oriented substantially perpendicular to the first and second face sheets. The plurality of channel shaped members and flanged members in FIG. 9 comprise two flanged web members.

Figure 10:
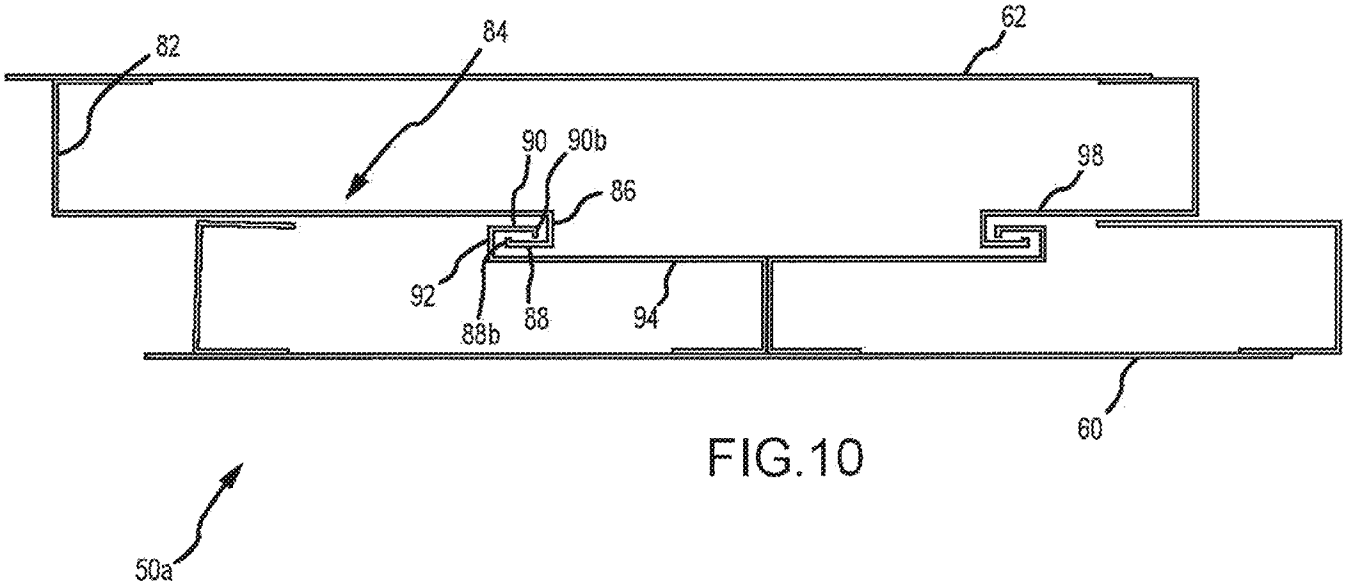
FIG. 10 is a top cross-sectional view of a structural assembly according to one embodiment.

FIG. 10 provides yet another embodiment of the present disclosure wherein an assembly 50*a* is provided comprising internal structural members 82, 84, 86, 88, 88*b*, 90, 90*b* extending from face sheets 60, 62. As shown, internal structural member 82 extends generally from face sheet 62 and is interconnected to laterally extending intermediate panel 84. Laterally extending intermediate panel 84 comprises a terminus, the terminus comprising a first 86, second 88, and third 88*b* internal structural member. First 86, second 88, and third 88*b* internal structural members are provided to interact with corresponding members 90*b*, 90, 92 extending from laterally extending intermediate member 94. Intermediate member 94 extends toward additional force-transmitting means 98 and/or is secured to face sheet 60.

In various embodiments, plug welding methods are employed to form and/or join members of a structural assembly in accordance with the present disclosure. Plug welds are provided, for example, to reduce the number of requisite welds to join various portions of the assembly, increase the structural integrity of the assembly, and facilitate manufacturing processes related to forming assemblies of the present disclosure. Plug welds may be provided at various locations including, but not limited to, locations for joining internal structural members 57, 58 to respective first and second face sheets 60, 62. In alternative embodiments, plug welds are provided at unions of face sheets 2, 4 and respective internal members 12, 14, 16.

Specific weld structures, arrangements, positioning, and type of the present disclosure vary based on usage requirements. In preferred embodiments, full seam welding is provided. In alternative embodiments, such as where cost considerations are present, internal structures can be skip welded to the face and spaced at approximately nine inch centers or less.

Figure 11:
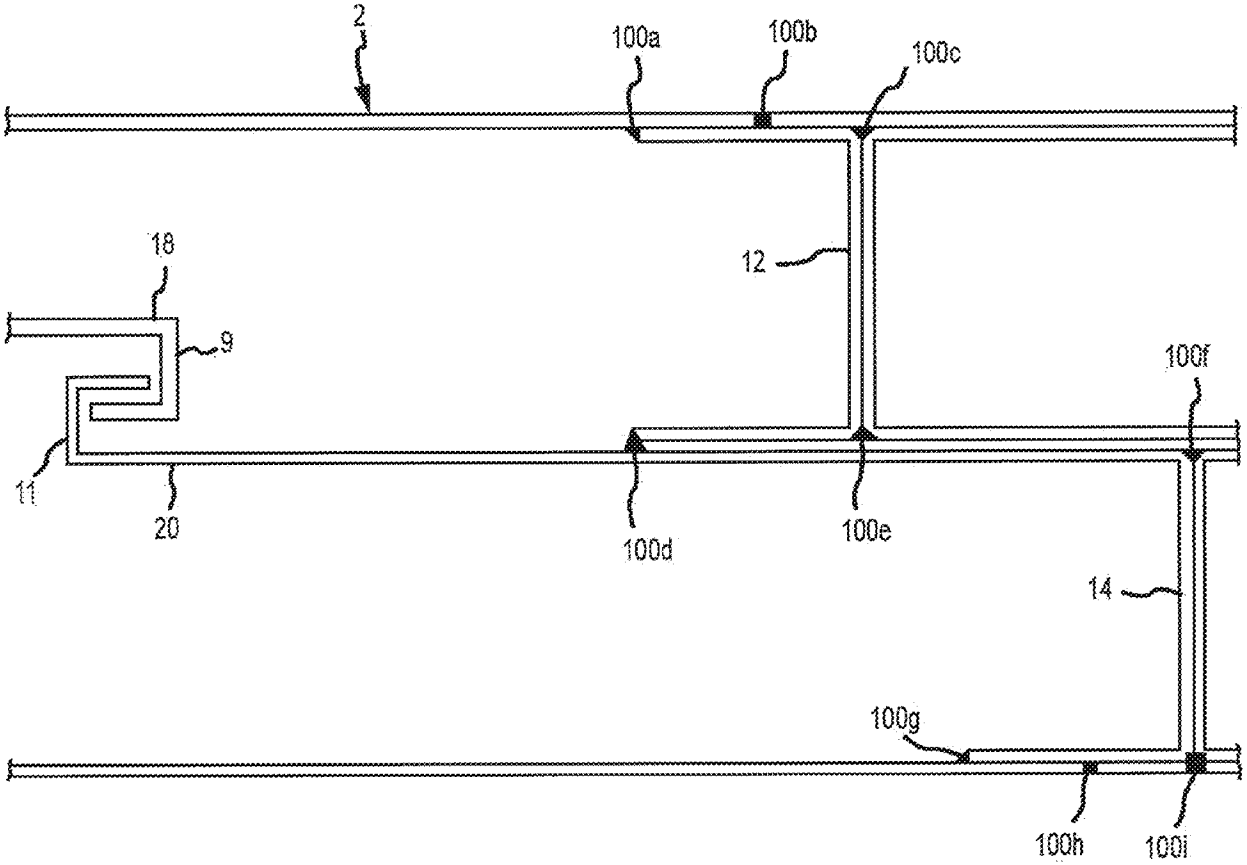
FIG. 11 is a top cross-sectional view of a structural assembly according to one embodiment.
Figure 12:
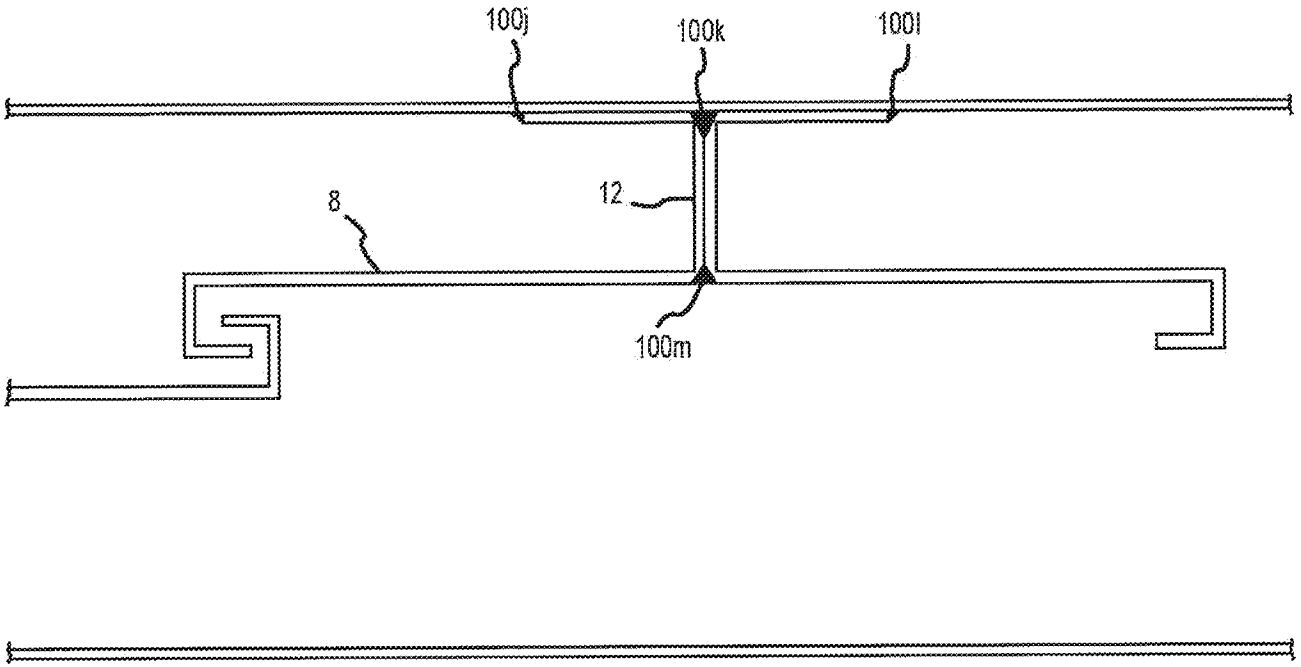
FIG. 12 is a top cross-sectional view of a structural assembly according to one embodiment.

FIGS. 11-12 depict one embodiment of an assembly 50*a* of the present disclosure, wherein various weld locations 100 are indicated. It will be expressly recognized, however, that FIGS. 11-12 are merely exemplary embodiments of structures formed with certain weld locations. The present disclosure is not limited to any particular type, arrangement, or positioning of welds and various welding options as will be recognized by one of skill in the art are contemplated as within the scope and spirit of the present disclosure.

Figure 13:
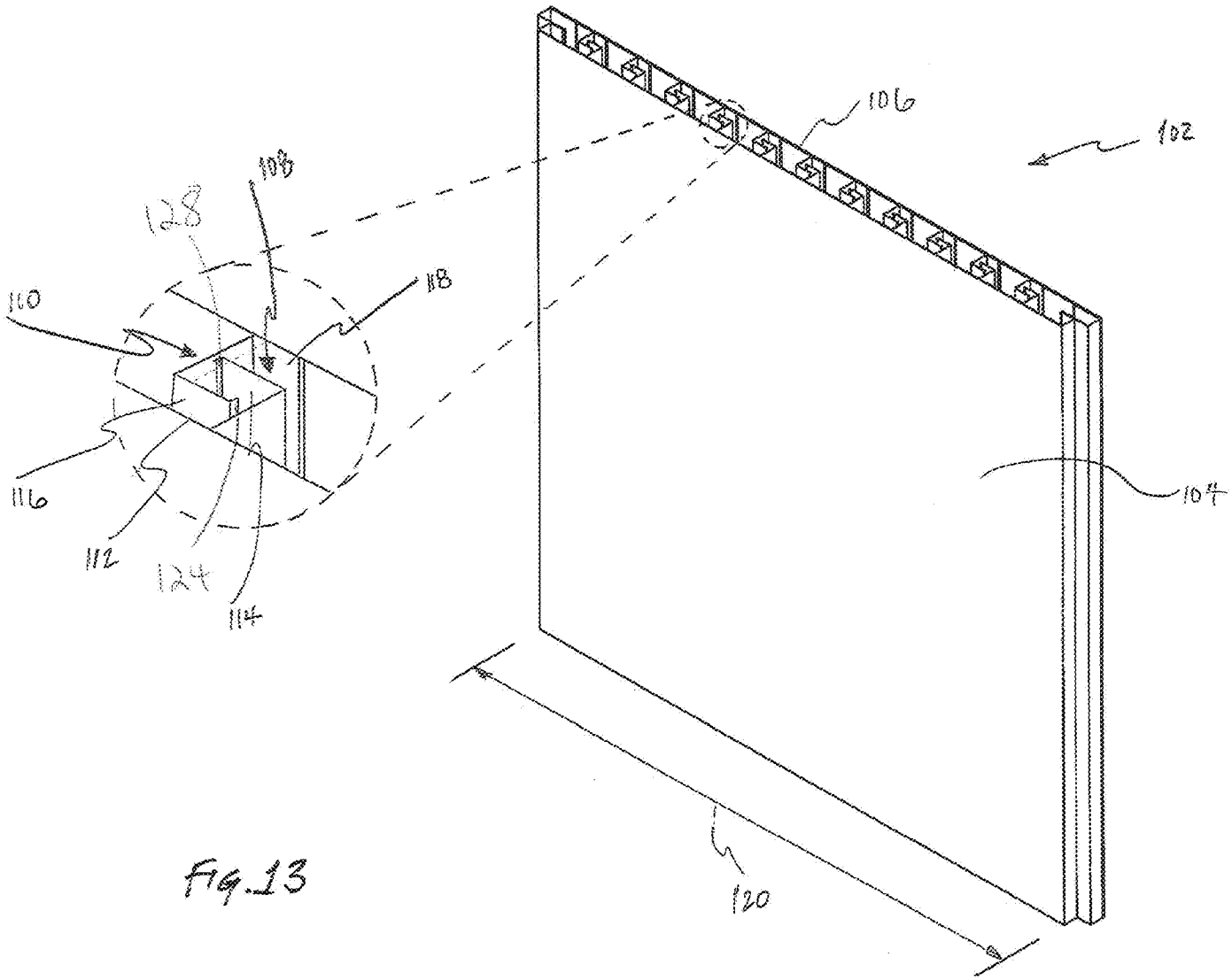
FIG. 13 is an isometric view if a portion of a structural assembly according to one embodiment of the invention.

FIG. 13 depicts another embodiment of an assembly 102 of the present disclosure wherein C-shaped, galvanized studs are utilized as interlocking channel members 108, 110. The assembly 102 comprises a first channel shaped member 108 and a second channel shaped member 110 and first and second face sheets 104, 106. The first channel shaped member 108 comprises two flanged web members 112, 114. The second channel shaped member 110 comprises two flanged web members 116, 118.

As shown in FIG. 13, a plurality of channel shaped members 108, 110 are provided such that a plurality of flanged web members 112, 114, 116, 118 are oriented substantially parallel to the first and second face sheets 104, 106. FIG. 13 also depicts the length 120 of the first face sheet 104. In one embodiment the length 120 is 10 feet, but this is only an example length and should not be viewed as a limitation. In a preferred embodiment, the length 120 is approximately between 12 feet and 8 feet. In a more preferred embodiment, the length 120 is approximately between 11 feet and 9 feet. In a most preferred embodiment, the length 120 is approximately between 10.5 feet and 9.5 feet. In one embodiment, the C-shaped, galvanized studs are commercial off-the-shelf C-shaped, galvanized studs. In a further embodiment, the C-shaped, galvanized studs are commercial off-the-shelf C-shaped, galvanized studs comprising four flanged web members.

In the embodiment depicted in FIG. 13, the channel shaped members 108, 110 further comprise secondary flanged web members 124, 128, respectively. In various embodiments, secondary flanged web members 124, 128 extend substantially perpendicularly from flanged web members 114, 116. Thus, when a load is applied to one of the face sheets 104, 106, the load is carried to the flanged web members 112, 114, 116, 118 and the secondary flanged web members 124, 128, which absorb energy from the load.

Secondary flanged web members 124, 128 provide a substantially interlocking arrangement for improved blast and fire resistance. In the event that the assembly 102 is subject to a shearing force that would displace the channel shaped members 108, 110 away from each other, the secondary flanged web members 124, 128 would contact each other. The secondary flanged web members 124, 128 would limit the distance which the channel shaped members 108, 110 could be displaced, and thus preserve the structural integrity of the assembly 102.

Figure 14:
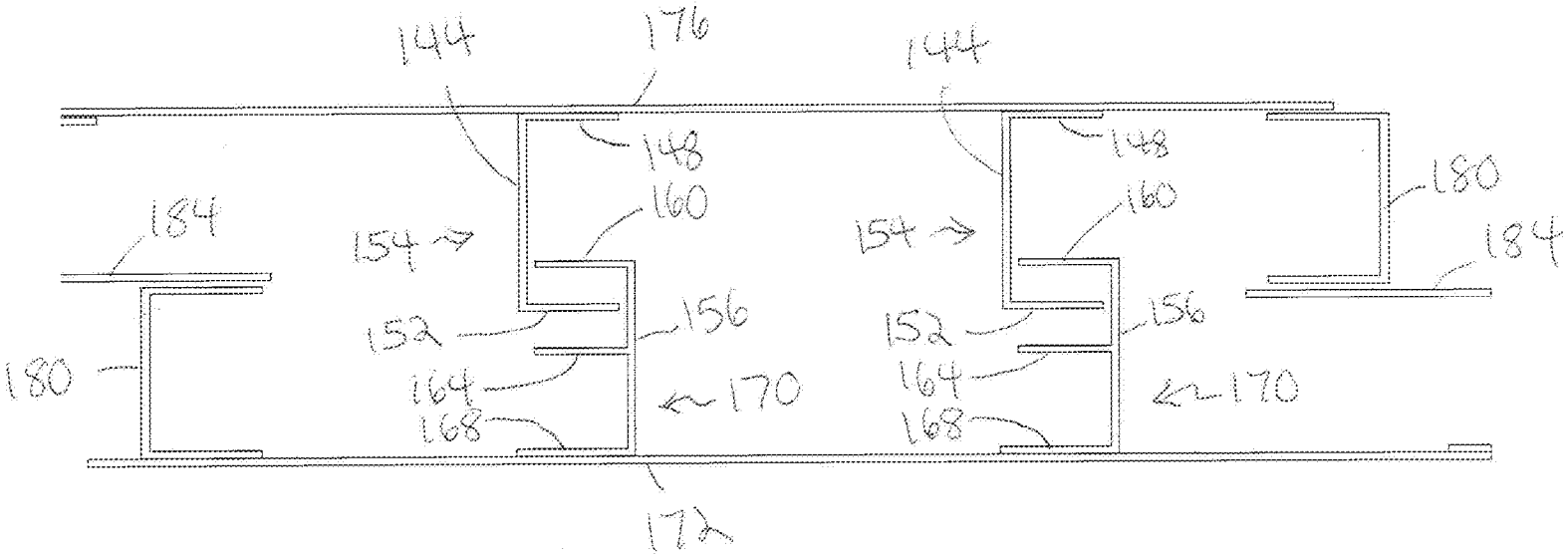
FIG. 14 is a cross-section view of a structural assembly according to one embodiment.

FIG. 14 depicts another embodiment of the present invention where the structural assembly 140 comprises C-shaped internal structural members 154, 170. As described above, different components of the invention may be commercial off-the-shelf materials, such as C-shaped studs or channels. The structural assembly 140 is shown having a first face sheet 176, a second face sheet 172, and a plurality of internal structural members 154, 170 configured to provide strength and stability to the structural assembly 140.

In one embodiment, the internal structural member 154 comprises flanged web members 148, 152 and a plate 144. Further, the internal structural member 170 comprises flanged web members 160, 164, 168 and a plate 156. Flanged web member 164 may be later interconnected to the plate 156 to complete the internal structural member 170 shown in FIG. 14.

In another embodiment, the internal structural member 170 may comprise multiple C-shaped members. Two C-shaped internal structural members may be interconnected such that a flanged web member from the first C-shaped member is interconnected to a flanged web member from the second C-shaped member to form the single flanged web member 164.

The internal structural member 154 is connected to the first face sheet 176, and the internal structural member 170 is connected to the second face sheet 172 such that the plates 144, 156 are oriented perpendicular to the face sheets 176, 172. However, one skilled in the art will appreciate different orientations to offer various advantages.

The flanged web member 152 is disposed between the flanged web members 160, 164. Thus, when a load is applied to the second face sheet 172 (the one to which internal structural member 170 is attached), the load is carried from the face sheet 172 and causes displacement of the plate 156 such that flanged web member 164 contacts flanged web member 152. The subsequent deformation of the internal structural members 154, 170 absorbs energy from the load.

Likewise, when a load is applied to the first face sheet 176 (the one to which internal structural member 154 is attached), the load is carried from the fact sheet 176 and causes displacement of the plate 144 such that flanged web member 152 contacts flanged web member 164.

The inclusion of flanged web member 160 limits how far apart the internal structural members 154, 172 can move away from each other. In the event that a force is applied away from a particular pair of internal structural members 154, 170, buckling of the structural assembly 140 may cause the internal structural members 154, 170 to move away from one another such that flanged web member 160 will contact flanged web member 152. This limiting features causes the internal structural members 154, 170 remain close to each other along with the face sheets 172, 176 to which they are connected, and the structural assembly 140 retains structural integrity.

The flanged web members 152, 160, 164 overlap each other to provide functionality to the structural assembly 140. In one embodiment, the flanged web members 152, 160, 164 extend the same length from their respective plates 144, 156. Thus, the distance between flanged web member 160 and plate 144 is the same as the distance between flanged web member 152 and plate 156. This distance may vary between zero to the full length of the flanged web members 152, 160, 164. One skilled in the art will appreciate flanged web members 152, 160, 164 may extend different lengths in different embodiments.

In the embodiment depicted in FIG. 14, a plurality of opposing intermediate panels 180, 184 are disposed between the first and second face sheets 172, 176. As shown, the opposing intermediate panels 180, 184 are positioned such that immediately adjacent panels 180, 184 are connected to different face sheets 172, 176. The opposing intermediate panels 180, 184 provide an initial distance between internal structural members 154, 170 before any of the above-described forces are applied to the structural assembly 140.

Figure 15:
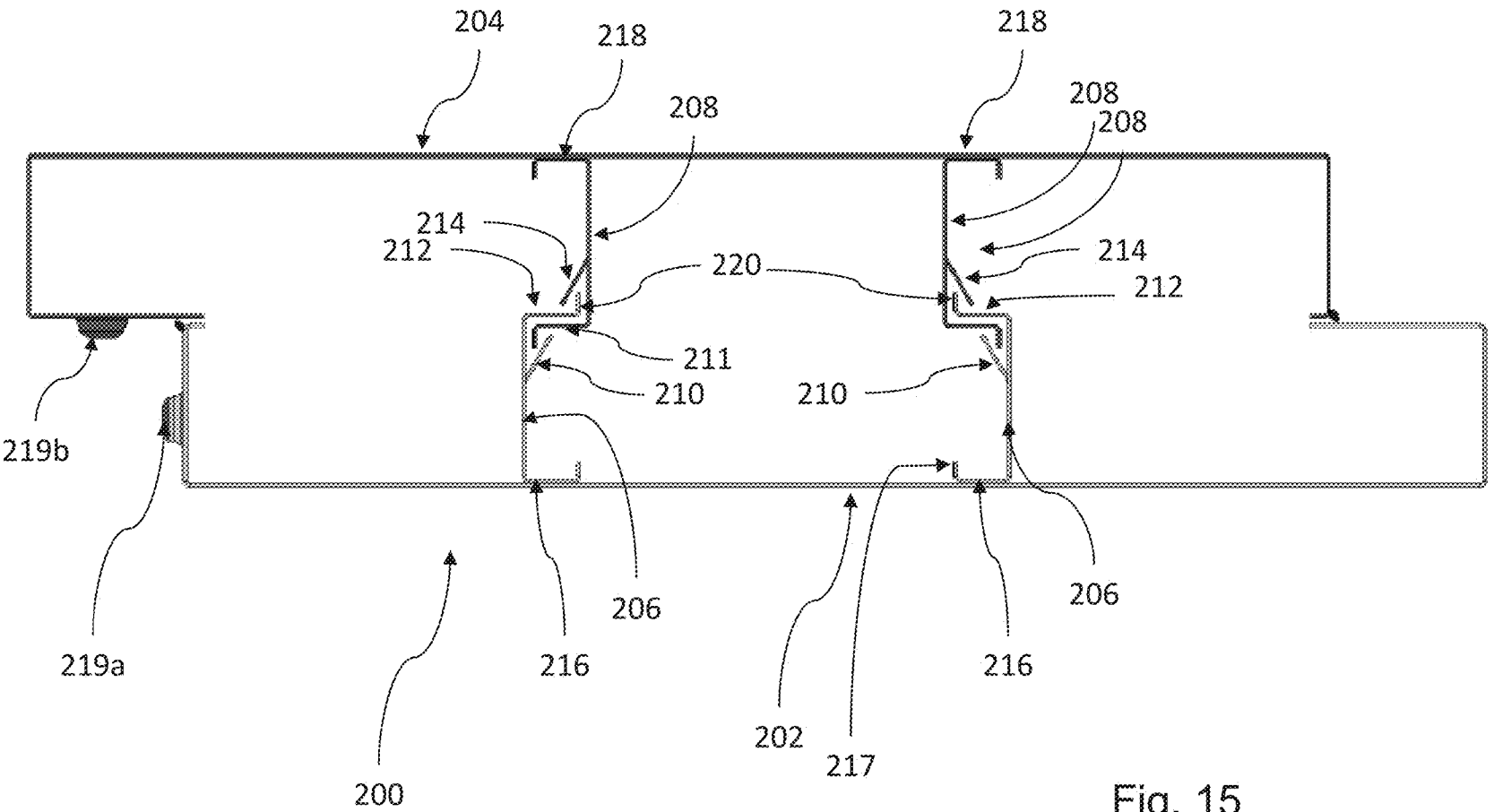
FIG. 15 is a top plan view of a structural assembly according to one embodiment of the present disclosure.

FIG. 15 is a top plan view of a structural assembly 200 for use in a building structure according to another embodiment of the present disclosure. As shown, the assembly 200 comprises a first face sheet 202 and a second face sheet 204, wherein at least one of the face sheets is adapted to be provided as a wall or outer surface panel of a building structure. The height of the sheets and assembly, although not shown in FIG. 15, may be of any desired magnitude. The first face sheet 202 comprises a first internal support member 206 extending inwardly from the first face sheet (i.e. toward the second face sheet). The first internal support member 206 comprises a first and a second end and a length extending therebetween. The second end comprises a bend or angle with a first panel 212 provided substantially perpendicular to the first internal support member 206. The first panel 212 comprises a second panel 220 at a distal end thereof and extending therefrom, the second panel 220 is provided substantially perpendicular to the first panel 212 and substantially parallel to the first internal support member 206. The first internal support member 206 further comprises at least one angled panel 210, the angled panel extending from the first internal support member at a predetermined angle. In various embodiments, the predetermined angle comprises an angle of between approximately 15 and 80 degrees. In preferred embodiments, the predetermined angle comprises an angle of between approximately 20 and 60 degrees.

As further shown in FIG. 15, the second face sheet 204 comprises a second internal support member 208 that is generally of the same construction as the first internal support member 206. Specifically, the second internal support member 208 of the depicted embodiment comprises the same features as the first internals support member, and as shown in FIG. 15 is rotated about a vertical axis to provide an opposing member adapted for communication and contact with the first internal support. Preferably, the first internal support 206 and the second internal support 208 and their associated features are provided proximal to each other but do not contact each other in a first position of use. FIG. 15 provides an assembled structural assembly 200 wherein certain internal components are provided in spaced apart relationship, and are adapted to only contact one another if and when the assembly 200 is deformed, such as may occur when the assembly 200 is impacted by a force.

In the embodiment provided in FIG. 15, distal ends of the first internal support member 206 and the second internal support member 208 each comprise at least one right angle and an associated impact panel 211, 212. The impact panels 211, 212 are provided and adapted to contact an angled panel 210, 211 upon deformation of the assembly under compressive loads. Specifically, where a compressive impact force or load is applied to either or both of the first face sheet 202 and the second face sheet 204, at least one of the angled panels 210, 211 will come into contact with an opposing impact panel 211, 212 to guide and/or direct force and movement of the assembly.

The first 206 and second internal support member 208 are preferably secured to an interior portion of the first 202 and second 204 face sheets, respectively. In various embodiments, the internal support members 206, 208 are welded, bonded, and/or adhered to an inner surface of the face sheets. The embodiment of FIG. 15 provides a plurality of first internals support members 206 and a plurality of second internal support members 208. It will be recognized that support assemblies of the present disclosure are not limited to any number of internal support members. Indeed, the structures of the present disclosure are designed and suited to be provided in a repeatable manner and the number of internal support members may be varied based on specific applications and/or an intended length of the structural assembly.

As further shown in FIG. 15, a plurality of connection fins or hinges 219*a*, 219*b* are provided and distributed along a height of the first and second face sheets 202, 204. The connection hinges 219*a*, 219*b* provide for connection of the sheets to additional components including, but not limited to, adjacent face sheets (not shown) and in certain embodiments obviate the need for welding. The connection hinges 219*a*, 219*b* further provide for quick assembly and disassembly of structures.

Preferably, the internal support members comprise C-shaped or partially C-shaped channel members having a connection interface 216 that is welded or otherwise secured to a face sheet. The connection interface 216 further comprises an extension 217 that facilitates fabrication of the channel or support and increases overall strength of the same.

Figure 16:
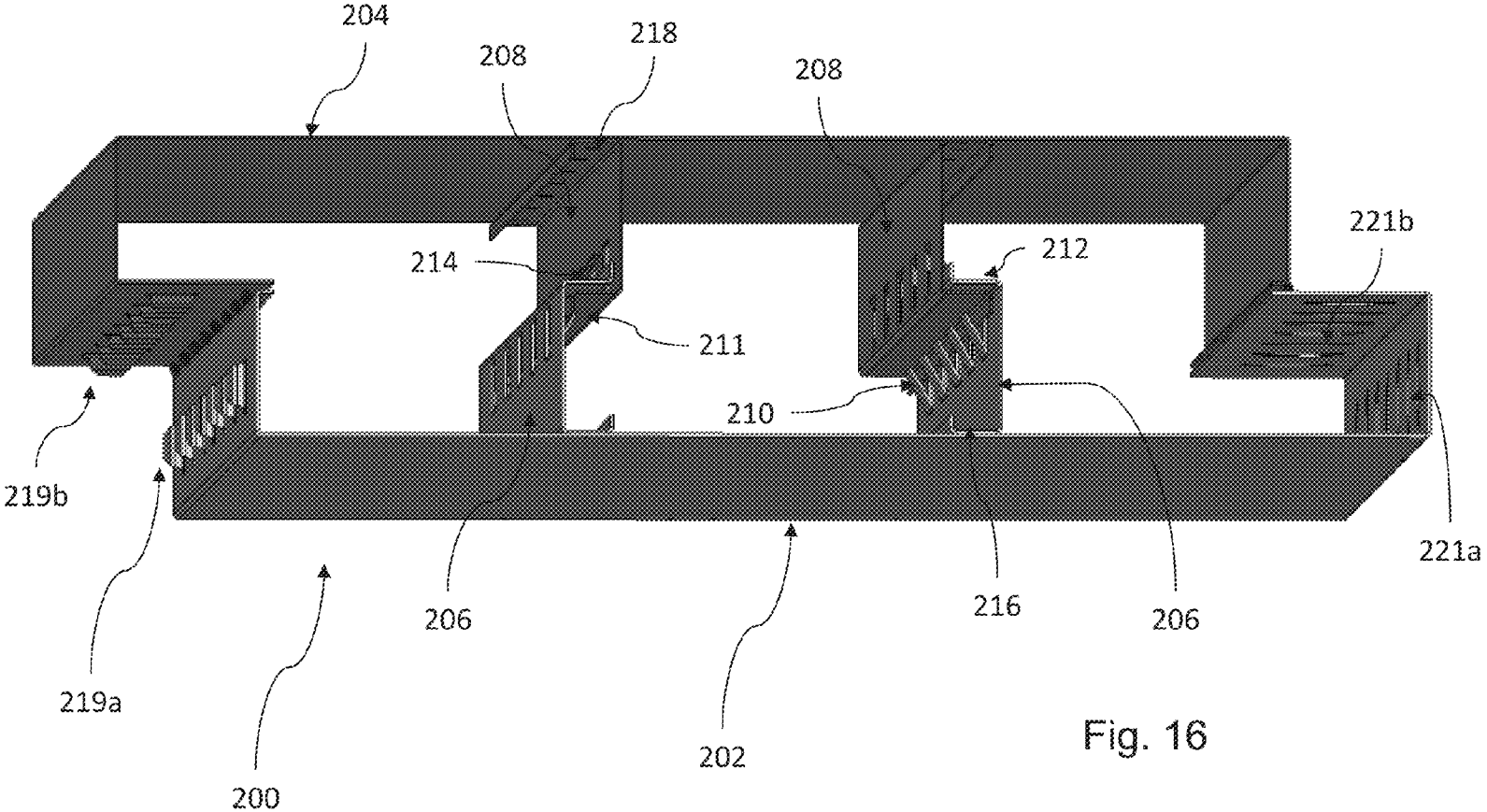
FIG. 16 is a top perspective view of the structural assembly of the embodiment of FIG. 15.

FIG. 16 is a top perspective view of the assembly 200 of the embodiment shown in FIG. 15. As shown in FIG. 16, a plurality of discrete angled panels 210, 214 are provided and distributed along at least a portion of the height of the internal support members 206, 208. The angled panels 210 are adapted to contact the first panel 212 of the opposing support member upon deformation of the assembly 200.

Figure 17:
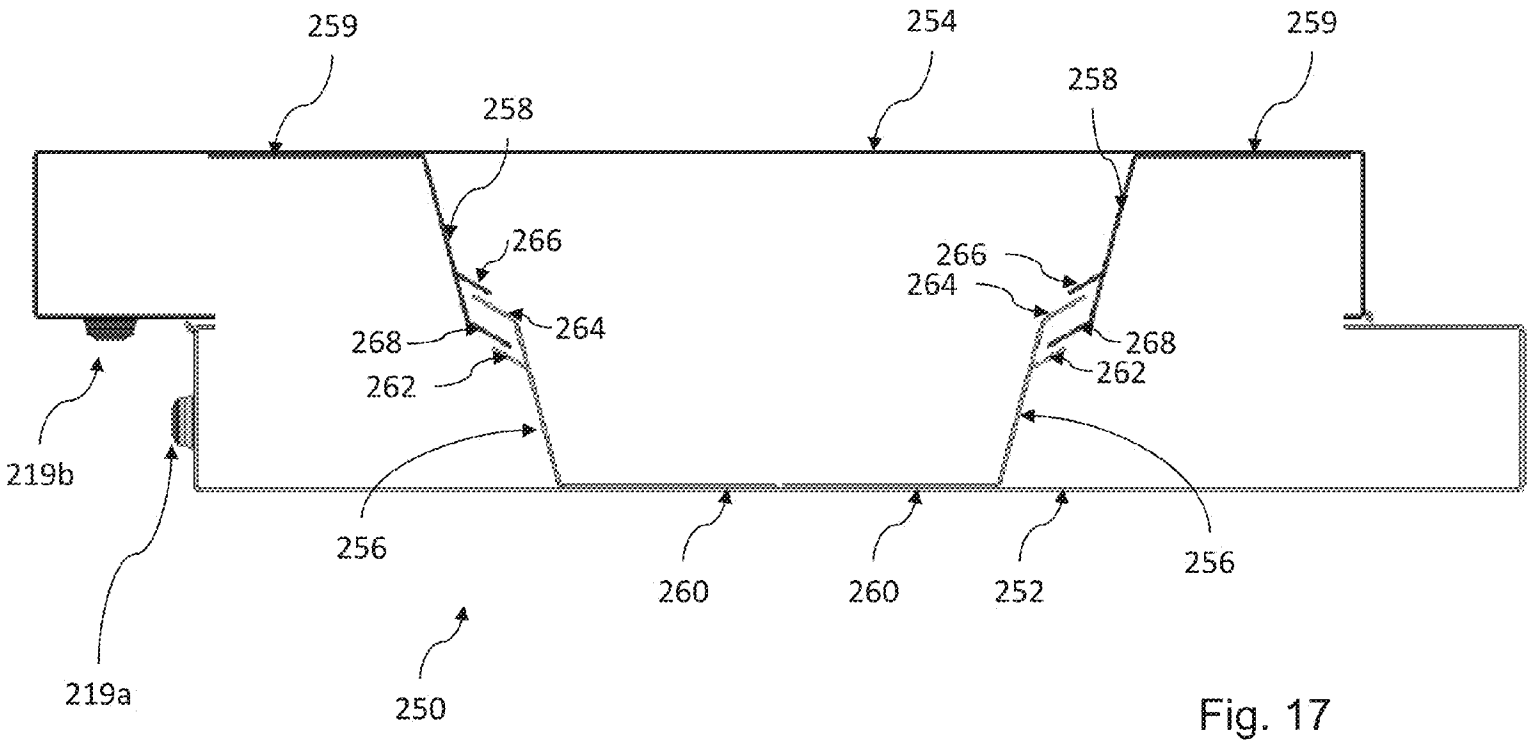
FIG. 17 is a top plan view of a structural assembly according to one embodiment of the present disclosure.

FIG. 17 is a top plan view of a structural assembly 250 according to yet another embodiment of the present disclosure. The structural assembly 250 comprises an outer face sheet 252 and an inner face sheet 254. The outer face sheet 252 comprises at least one angled internal support member 256. The angled internal support member 256 comprises a securing portion 260 that is secured to an inner portion of the outer face sheet 252 by any one or more of welding, riveting, bolting, and adhering. The angled internal support member 256 extends away from an interior portion of the outer face sheet at a predetermined angle. In various embodiments, the predetermined angle comprises an angle of between approximately 60 and 90 degrees. In preferred embodiments, the angled internal support member comprises a predetermined angle of approximately 75 degrees. The angled internal support member 256 comprises a first angled panel 262 and a second angled panel 264 extending from the member 256. In the depicted embodiment, the second angled panel 264 is provided at a distal end of the angled internal support member 256, and the first angled panel 262 is provided along a length of the member 256 and spaced apart from the second angled panel 264. In various embodiments, the angled panels 262, 264, 266, 268 extend at an angle with respect to a corresponding angled internal support member of between approximately 30 and 60 degrees, and more preferably approximately 40 degrees.

In the embodiment provided in FIG. 17, the second face sheet 254 comprises at least one angled internal support member 258 comprising the same or similar construction as the angled internal support member 256 secured to the first face sheet 252. FIG. 17 depicts the structural assembly 250 in an assembled position wherein an angled internal support member 256 of a first face sheet 252 is spaced apart from an angled internal support member 258 of the second face sheet 254. The angled panels 262, 264, 266, 268 are adapted to come into force-transmitting contact with opposing angled panels and an opposing angled internal support member when the structure is impacted by a projectile, explosion, etc.

Figure 18:
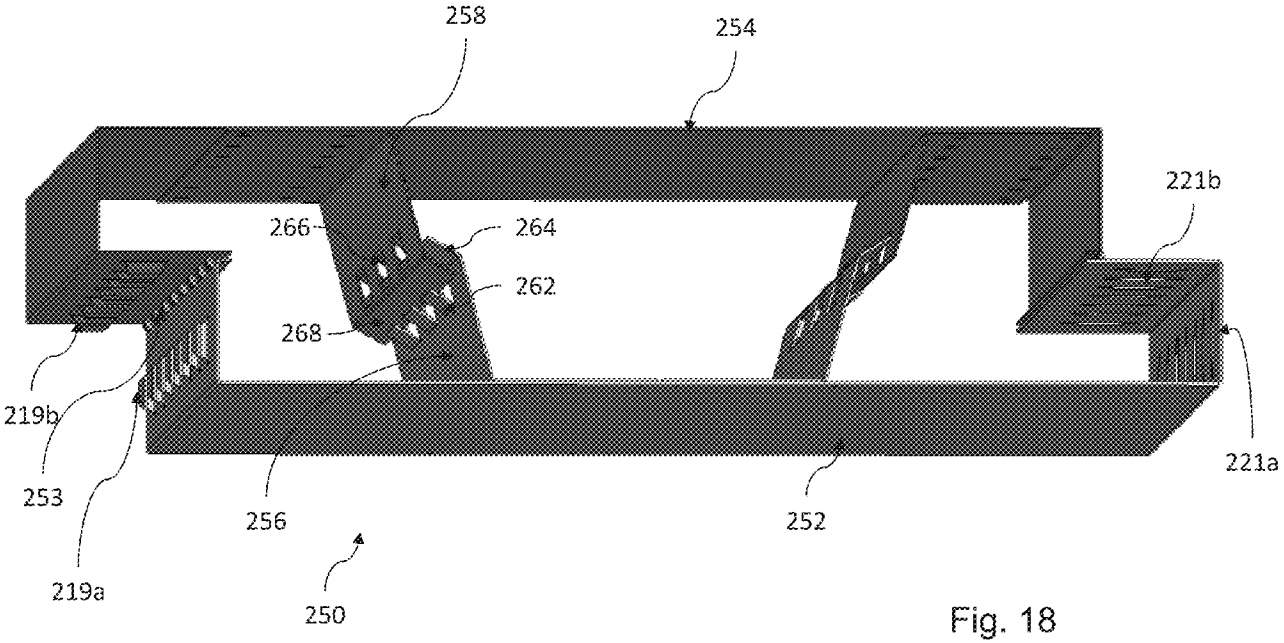
FIG. 18 is a top perspective view of the structural assembly of the embodiment of FIG. 17.

FIG. 18 is a top perspective view of a structural assembly 250 according to the embodiment of FIG. 17. As shown, the assembly 250 comprises angled internal support members 256, 258 secured to first and second face sheets 252, 254, respectively. As shown in the embodiment of FIG. 18, a plurality of first angled panels 262, 266 are provided on the first and second angled internal support members 256, 258, respectively. The first angled panels 262, 266 comprise a plurality of discrete angled panel members formed or cut from a blank of material of the support members 256, 258, thus leaving apertures or cut-outs in the support member 256, 258. In alternative embodiments, the angled panel members comprise separate components or features that are secured to the support members 256, 258 without the need to cut or modify the existing material of the support member 256, 258. The second angled panels 264, 268 of the depicted embodiment are provided as a single angled panel 264, 268 extending from the first angled internal support member 256 and the second angled internal support member. In preferred embodiments, the second angled panels 264, 268 are formed by bending a distal portion of the respective internal support member 256, 258. In alternative embodiments, however, it is contemplated that the second angled panels 264, 268 comprise discrete components that are secured to a distal end of the respective internal support member 256, 258.

As further shown in FIG. 18, the assembly 250 comprises a discrete element that may be provided in series connection with one or more additional assemblies of the same or similar construction. Connection hinges 219*a*, 219*b* provided at one of the assembly are provided to interconnect with and secure to apertures or vents 221*a*, 221*b* provided in a second end of the assembly 250. In various embodiments, the connection hinges 219*a*, 219*b* comprise flexible or hinged components that may be selectively rotated or bent. Alternatively, the connection hinges 219*a*, 219*b* comprise substantially rigid fins or extensions adapted for insertion into vents 221*a*, 221*b* of an adjacent assembly 250.

Figure 19:
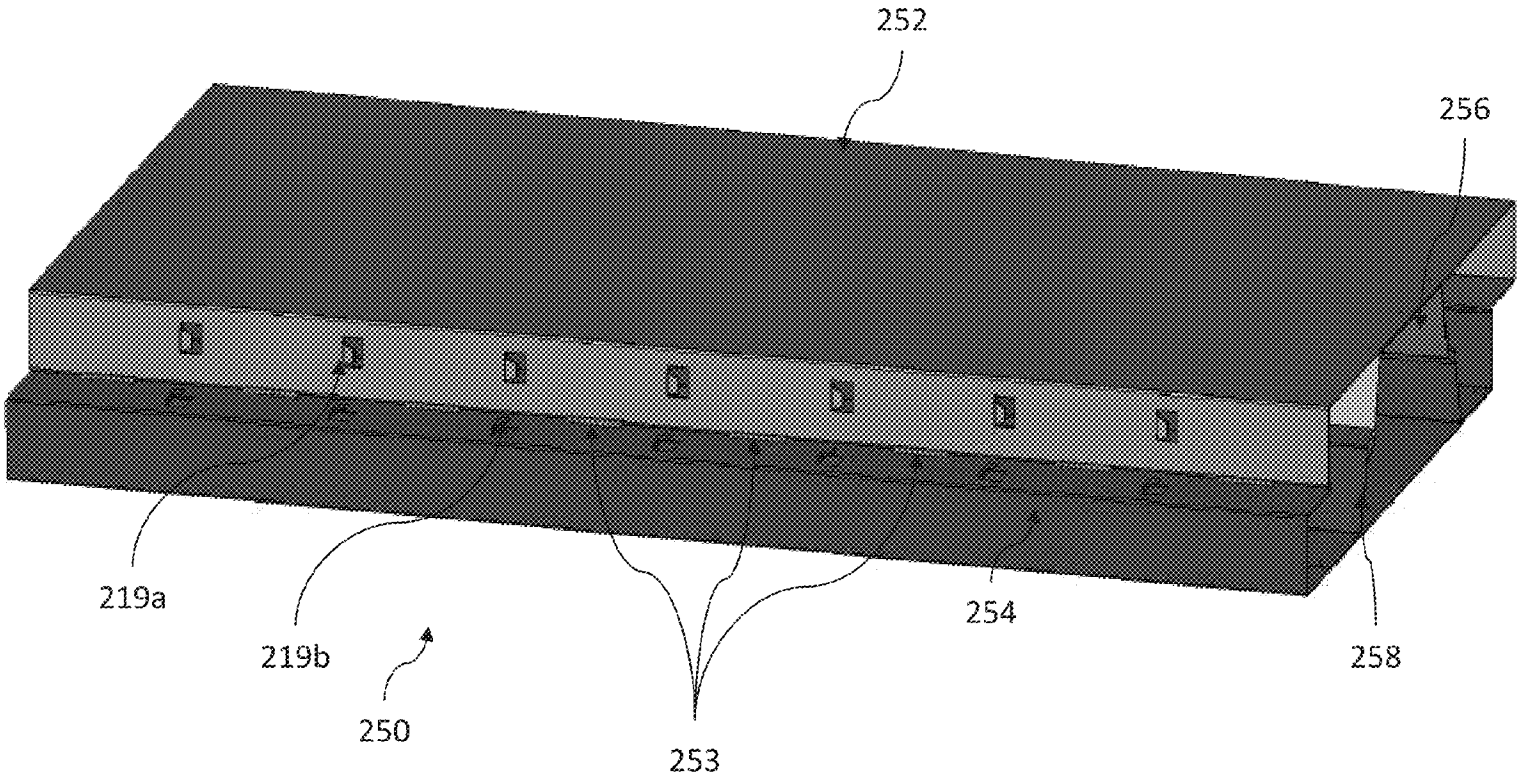
FIG. 19 is a side perspective view of the structural assembly of the embodiment of FIG. 17.

FIG. 19 is a perspective view of first 252 and second 254 face sheets secured together. As previously shown and described, angled support members 256, 258 are provided proximal to each and adapted to receive and transmit a load, force, or impact. The angled support member 256, 258 are not secured in a first assembled state, but provided proximal to each other and adapted for contact upon deformation of the assembly 250. The first and second face sheets 252, 254 are secured to one another by a plurality of welds 253 provided along a height of the sheets.

Figure 20:
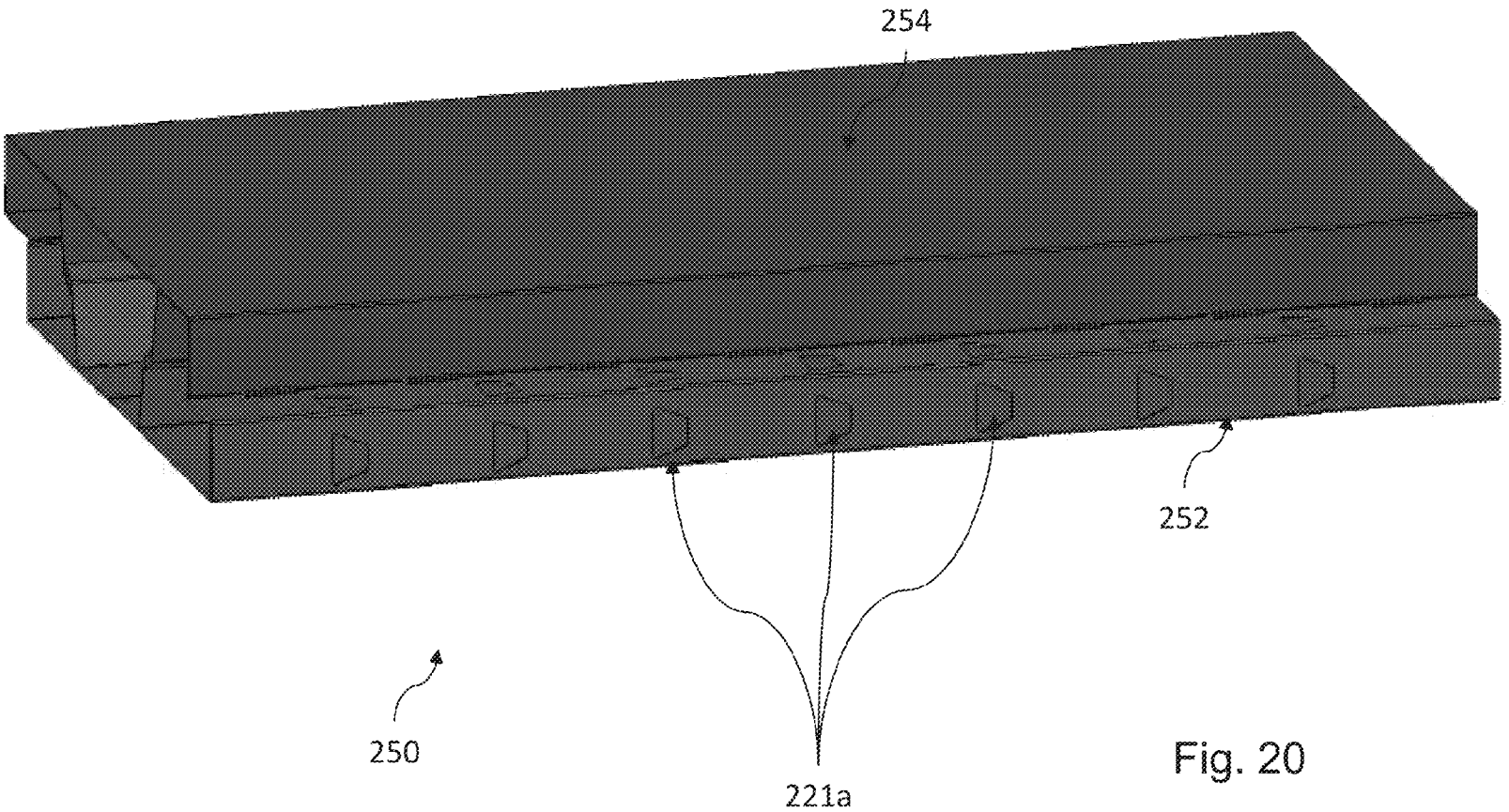
FIG. 20 is a side perspective view of the structural assembly of the embodiment of FIG. 17.

FIG. 20 is a perspective view of first 252 and second 254 face sheets secured together, and taken from a substantially opposite angle as FIG. 19. A plurality of vents 221*a* are shown as comprising knock-out features adapted to be quickly and easily removed during on-site installation and erection of the assembly 250. As shown in FIG. 20, the vents 221*a* comprise substantially trapezoidal shaped features. It will be expressly recognized, however, that the specific shape of the vents 221*a*, 221*b* is not critical to the present disclosure. Indeed, various shaped and sized vents are contemplated for use with embodiments of the present disclosure.

Figure 22:
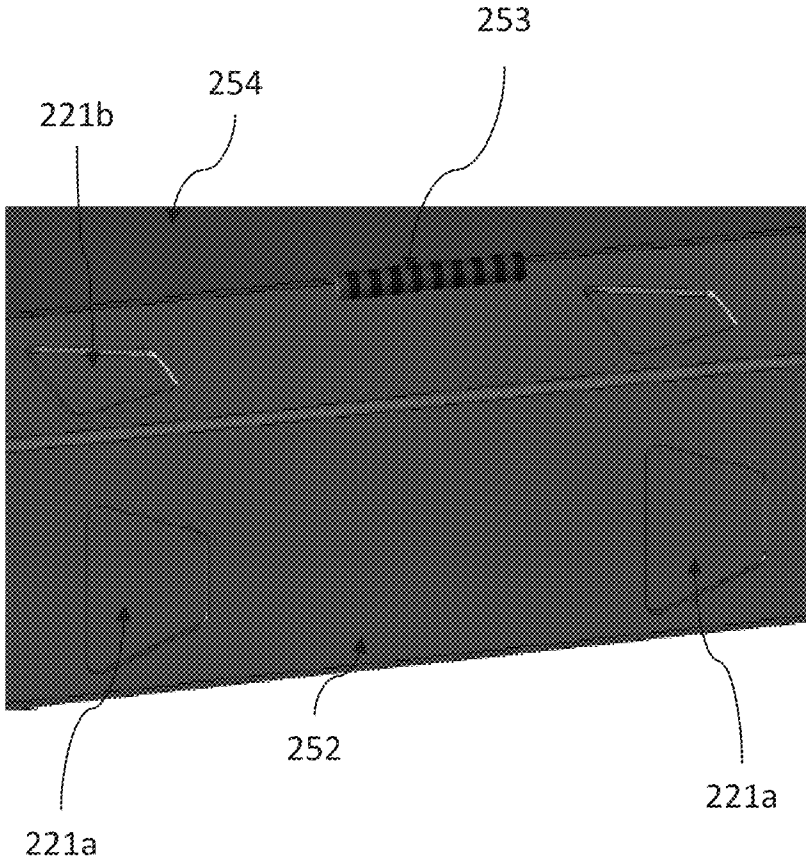
FIG. 22 is a detailed side view of the structural assembly of the embodiment of FIG. 17.
Figure 21:
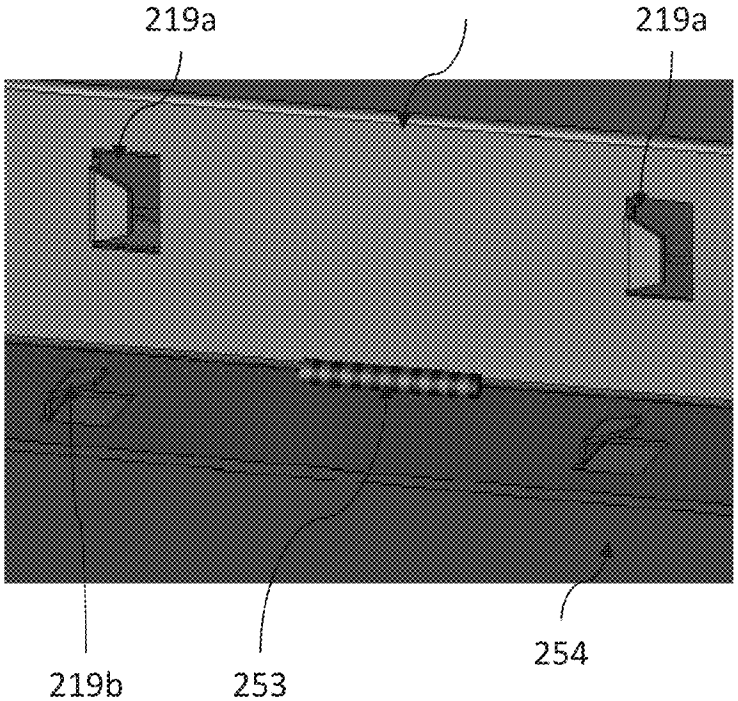
FIG. 21 is a detailed side view of the structural assembly of the embodiment of FIG. 17.

FIGS. 21-22 provide detailed perspective views of the features shown in FIGS. 19-20. As shown in FIG. 21, a first 252 and second 254 face sheet are secured together by at least one weld 253 and comprise a corner feature with connectors 219*a*, 219*b* provided on planar members forming a right angle. The connectors 219*a*, 219*b* are adapted to be provided with and interconnect with apertures, slots or vents 221*a*, 221*b* provided on an opposing end of a second assembly unit 250 and as shown in FIG. 22. A connection may be established at least in part by providing the connectors 219*a*, 219*b* in communication with the vents 221*a*, 221. The assembly may be secured using these features and/or additional features may be provided including, for example, additional welds.

It will be understood that the description and drawings presented herein represent an embodiment of the invention, and are therefore merely representative of the subject matter that is broadly contemplated by the invention. Thus, for example, although the drawings do not represent the invention as part of a completed building structure, it will be appreciated by one of ordinary skill in the art that such a completed building structure is contemplated. It will be further understood that the scope of the present invention encompasses other embodiments that may become obvious to those skilled in the art.

What is claimed is:

1. A structural assembly for use in constructing a building structure, the assembly comprising:

a first face sheet;

a second face sheet, wherein the second face sheet is substantially parallel to the first face sheet;

a first internal support connected to and extending inwardly from the first face sheet;

a second internal support connected to and extending inwardly from the second face sheet;

each of the first internal support and the second internal support extending toward an opposing face sheet;

each of the first internal support and the second internal support comprising a first end and a second end and a predetermined length therebetween, the first ends provided proximal the first and second face sheets, respectively, and the second ends provided proximal to each other;

wherein each of the first and second internal supports comprise a plurality of angled panels extending at an angle of between approximately 20 and 60 degrees from the first and second internal supports;

wherein the second ends each of the first and second support members comprise an impact panel, wherein the impact panel of the first support member is provided at a right angle to at least a portion of the first support member and the impact panel of the second support member is provided at a right angle to at least a portion of the second support member;

wherein the first internal support member and the second internal support member are provided in a spaced apart manner in a first position of use, the first position of use corresponding to a position wherein the assembly has not been deformed, and wherein the first internal support member and the second internal support member are provided in force transmitting communication with each other when at least one of the first and second face sheets are impacted by a force; and wherein at least one of the plurality of angled panels of the first support member is operable to contact the impact panel of the second support member when the structural assembly is deformed.

2. The structural assembly according to claim 1, wherein each of the internal support members comprise at least three angled panels.

3. The structural assembly according claim 1, wherein the first internal support extends inwardly from the first face sheet at an angle that is substantially perpendicular to the first face sheet.

4. The structural assembly according claim 1, wherein the second internal support extends inwardly from the second face sheet at an angle that is substantially perpendicular to the second face sheet.

5. The structural assembly according claim 1, wherein the structural assembly is provided in a plurality of discrete sections adapted for on-site assembly.

6. The structural assembly according claim 1, wherein at least one of the first internal support and the second internal support is secured to at least one face sheet by at least one fastening element selected from the group consisting of welding, chemical bonding, insulation material, and mechanical fasteners.

7. The structural assembly according claim 1, wherein the first internal support extends inwardly from the first face sheet at an angle of between approximately sixty degrees and approximately ninety degrees.

8. A structural assembly for use in constructing a building structure, the assembly comprising:

a first face sheet;

a second face sheet, wherein the second face sheet is substantially parallel to and spaced apart from the first face sheet;

a first internal support member connected to and extending inwardly from the first face sheet;

a second internal support member connected to and extending inwardly from the second face sheet;

the first internal support member comprising a first end secured to the first face sheet and a second end comprising a free end, and a length provided between the first end and the second end;

the second internal support member comprising a first end secured to the second face sheet and a second end comprising a free end, and a length provided between the first end and the second end;

an angled panel member provided along the length between the first end and the second of the first internal support member, the angled panel member adapted to contact the second end of the second internal support member upon a deformation of the assembly;

the angled panel member provided at an angle of between approximately 20 and 60 degrees with respect to at least a portion of the first internal support member;

the second internal support member comprising an impact panel, the impact panel provided at a right angle to at least a portion of the second internal support member; and wherein the first internal support member and the second internal support member are provided in a spaced apart manner in a first position of use, the first position of use corresponding to a position wherein the assembly has not been deformed, and wherein the angled panel member is operable to contact the impact panel of the second support member such that the first internal support member and the second internal support member are provided in force transmitting communication with each other when at least one of the first and second face sheets are deformed.

* * * * *